US009792777B2

(12) United States Patent
Fujisawa et al.

(10) Patent No.: US 9,792,777 B2
(45) **Date of Patent: *Oct. 17, 2017**

(54) GAMING MACHINE AND CONTROL METHOD THEREOF

(71) Applicants: Universal Entertainment Corporation, Tokyo (JP); Aruze Gaming America, Inc., Las Vegas, NV (US)

(72) Inventors: Masumi Fujisawa, Tokyo (JP); Hideko Aoki, Tokyo (JP); Toshitaka Suzuki, Tokyo (JP); Hiromoto Yamauchi, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 369 days.

This patent is subject to a terminal disclaimer.

(21) Appl. No.: 14/259,218

(22) Filed: Apr. 23, 2014

(65) Prior Publication Data

US 2014/0335932 A1 Nov. 13, 2014

(30) Foreign Application Priority Data

May 13, 2013 (JP) ..... 2013-101373

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/3244
See application file for complete search history.

(56) References Cited

U.S. PATENT DOCUMENTS

2008/0146330 A1 6/2008 Yoshizawa
2009/0104973 A1 4/2009 Kato
2010/0048286 A1* 2/2010 Okada ..... G07F 17/3267 463/20

(Continued)

FOREIGN PATENT DOCUMENTS

CN 101206781 6/2008

OTHER PUBLICATIONS

The Office Action, MACAU State Intellectual Property Office of the P.R.C, dated Jun. 29, 2015, Macanese Application No. I/1277.

*Primary Examiner* — Jay Liddle
*Assistant Examiner* — Ankit Doshi
(74) *Attorney, Agent, or Firm* — Lex IP Meister, PLLC

(57) ABSTRACT

Symbols to be rearranged on the lower image display panel are randomly selected. When the combination of the rearranged symbols results in the establishment of a bonus trigger, how many BONUS symbols are included in the combination of the symbols is counted. Random determination based on a free game number random determination table is executed for a number of times corresponding to the counted number of the BONUS symbols. The randomly-determined total number of times of execution of the free game is awarded as the number of times of execution of the free game. Furthermore, when the number of the BONUS symbols including the combination of the symbols resulting in the establishment of the bonus game trigger is 15, the right to execute the free game 50 times is awarded.

9 Claims, 39 Drawing Sheets

(56) References Cited

U.S. PATENT DOCUMENTS

2010/0120510 A1* 5/2010 Saito ..... G07F 17/3244
463/20
2011/0250947 A1 10/2011 Okamoto

* cited by examiner

FIG.6

| | FIRST VIDEO REEL | SECOND VIDEO REEL | THIRD VIDEO REEL | FOURTH VIDEO REEL | FIFTH VIDEO REEL |
|---|---|---|---|---|---|
| CODE NO. | SYMBOL | SYMBOL | SYMBOL | SYMBOL | SYMBOL |
| 00 | CURRENCY | DRESS | EMPEROR | A | Q |
| 01 | BOX SYMBOL | BOX SYMBOL | BOX SYMBOL | BOX SYMBOL | BOX SYMBOL |
| 02 | BOX SYMBOL | BOX SYMBOL | BOX SYMBOL | BOX SYMBOL | BOX SYMBOL |
| 03 | BOX SYMBOL | BOX SYMBOL | BOX SYMBOL | BOX SYMBOL | BOX SYMBOL |
| 04 | BOX SYMBOL | BOX SYMBOL | BOX SYMBOL | BOX SYMBOL | BOX SYMBOL |
| 05 | 10 | CASTLE | DRAGON | EMPEROR | WILD |
| 06 | BOX SYMBOL | 9 | BOX SYMBOL | 9 | WILD |
| 07 | EMPEROR | CURRENCY | CASTLE | DRESS | DRAGON |
| 08 | 10 | EMPEROR | DRESS | J | J |
| 09 | J | Q | WILD | A | DRESS |
| 10 | CASTLE | DRESS | 9 | DRAGON | A |
| 11 | 9 | BOX SYMBOL | Q | BOX SYMBOL | EMPEROR |
| 12 | J | CASTLE | CURRENCY | DRESS | 10 |
| 13 | DRAGON | A | A | CASTLE | Q |
| 14 | BONUS | CURRENCY | BONUS | CURRENCY | CASTLE |
| 15 | A | BONUS | 10 | BONUS | Q |
| 16 | WILD | CURRENCY | A | 10 | CURRENCY |
| 17 | Q | 10 | CURRENCY | Q | BOX SYMBOL |
| 18 | DRESS | DRAGON | 9 | J | DRESS |
| 19 | CURRENCY | Q | 10 | WILD | CURRENCY |
| 20 | CASTLE | J | Q | Q | 9 |
| 21 | Q | J | J | CURRENCY | EMPEROR |

FIG.9

191

| SYMBOL | 3 SYMBOLS | 4 SYMBOLS | 5 SYMBOLS |
|---|---|---|---|
| J | 10 | 20 | 100 |
| Q | 10 | 20 | 100 |
| 9 | 10 | 20 | 100 |
| A | 10 | 20 | 100 |
| 10 | 20 | 50 | 200 |
| CURRENCY | 20 | 50 | 200 |
| DRESS | 20 | 50 | 200 |
| DRAGON | 30 | 60 | 300 |
| CASTLE | 30 | 100 | 400 |
| EMPEROR | 40 | 150 | 500 |
| WILD | 50 | 200 | 1000 |
| BONUS | BONUS GAME(※) | | |

(※) BONUS GAME IS AWARDED WHEN AT LEAST ONE BONUS SYMBOL IS REARRANGED IN EACH OF FIRST, SECOND, AND THIRD VIDEO REELS

FIG.10

192

| NUMBER OF BONUS SIMBOLS / OBTAINED NUMBER OF TIMES OF EXECUTION OF FREE GAME | 3 SYMBOLS | 4 SYMBOLS | 5 SYMBOLS | 6 SYMBOLS | 7 SYMBOLS | 8 SYMBOLS | 9 SYMBOLS | 10 SYMBOLS | 11 SYMBOLS | 12 SYMBOLS | 13 SYMBOLS | 14 SYMBOLS | 15 SYMBOLS |
|---|---|---|---|---|---|---|---|---|---|---|---|---|---|
| | Very_Low | | | Low | | | Middle | | High | | Very_High | | EXTRA |
| 3 | 50/100 | | | 40/100 | | | 10/100 | | 5/100 | | 5/100 | | 2/100 |
| 6 | 30/100 | | | 30/100 | | | 20/100 | | 5/100 | | 5/100 | | 3/100 |
| 9 | 10/100 | | | 10/100 | | | 20/100 | | 10/100 | | 5/100 | | 5/100 |
| 12 | 7/100 | | | 12/100 | | | 20/100 | | 30/100 | | 20/100 | | 20/100 |
| 15 | 2/100 | | | 5/100 | | | 20/100 | | 20/100 | | 25/100 | | 20/100 |
| 30 | 1/100 | | | 3/100 | | | 10/100 | | 30/100 | | 40/100 | | 50/100 |
| TOTAL | 100/100 | | | 100/100 | | | 100/100 | | 100/100 | | 100/100 | | 100/100 |

FIG.11

193

| NO | PAYOUTS | WINNING PROBABILITIES |
|---|---|---|
| 201A | 10 | 10/71 |
| 201B | 80 | 4/71 |
| 201C | 20 | 10/71 |
| 201D | 90 | 3/71 |
| 201E | 30 | 10/71 |
| 201F | 70 | 4/71 |
| 201G | 40 | 10/71 |
| 201H | 60 | 6/71 |
| 201I | 100 | 5/71 |
| 201J | 50 | 9/71 |
| | TOTAL | 71/71 |

GAMING MACHINE AND CONTROL METHOD THEREOF

CROSS REFERENCE TO RELATED APPLICATION

The present application claims priority from Japanese Patent Application No. 2013-101373, which was filed on May 13, 2013, the disclosure of which is herein incorporated by reference in its entirety.

BACKGROUND OF THE INVENTION

The present invention relates to a gaming machine and a control method of the gaming machine.

An example of a known slot machine (gaming machine) is disclosed by Patent Literature 1 (U.S. Laid-Open Patent Application No. 2011/0250947). This slot machine operates in such a way that, when a player inserts a coin, bill or the like into an insertion slot of a slot machine and presses a spin button, symbols are scroll-displayed on a symbol display area provided on the front surface of a cabinet, and then the symbols are automatically stopped. Based on the state of the stopped symbols, various prizes such as a bonus are established.

Among such slot machines awarding a bonus or the like, there is a slot machine in which a plurality of types of bonuses are provided, and one of these bonuses is selected in response to a player's operation of an input device such as a button and the selected bonus is awarded (see e.g., Patent Literature 2 (U.S. Laid-Open Patent Application No. 2009/0104973)).

SUMMARY OF THE INVENTION

The player of the above-described slot machine (gaming machine) with a plurality of types of bonuses typically has a great interest in the contents and effects of the bonuses when playing games.

An object of the present invention is to provide a gaming machine providing new forms of bonus awarding as a novel entertainment feature, and a control method of the gaming machine.

The present invention relates to a gaming machine running a normal game and a bonus game developing from the normal game, the gaming machine including:

a symbol display device configured to display a result of a game by rearranging symbols;

a storage device configured to store a free game number random determination table in which the number of times of execution of a free game is associated with a random number; and a controller, the controller being programmed to execute the processes of:

(1A) as the normal game, randomly selecting the symbols which are to be rearranged on the symbol display device;

(1B) rearranging the symbols selected in the process (1A) on the display device and awarding a benefit in accordance with a combination of the rearranged symbols;

(1C) when the benefit awarded in the process (1B) is the right to run the bonus game, counting how many predetermined bonus symbol is included in the combination of the symbols with which the right to run the bonus game is awarded;

(1D) performing random determination based on the free game number random determination table for the number of times corresponding to the number of the predetermined bonus symbol counted in the process (1C); and (1E) when the number of the predetermined bonus symbol counted in the process (1C) is equal to or larger than a predetermined number, awarding the right to execute the free game for a predetermined number of time;

(1F) as the number of times of execution of the free game, awarding the total number calculated by adding up the number of times of execution of the free game randomly determined in the process (1D) and the number of times of execution of the free game awarded in the process (1E).

According to the arrangement above, when in the normal game symbols are rearranged on the symbol display device and a benefit awarded for the combination of the rearranged symbols is the right to execute the bonus game, how many predetermined bonus symbols are included in the combination of the rearranged symbols is counted. Random determination is executed based on the free game number random determination table for a number of times corresponding to the number of the predetermined bonus symbols, and the total number of times of execution of the free game awarded as a result of the random determination is awarded to the player.

Furthermore, when the number of the predetermined bonus symbols in the combination of the rearranged symbols is equal to or larger than a predetermined number, the right to execute the free game for a predetermined number of times is further awarded.

According to this arrangement, when the right to execute the bonus game is obtained, the larger the number of the predetermined bonus symbols in the combination of the rearranged symbols is, the more frequently the random determination of the number of times of execution of the free game to be awarded is executed. Furthermore, when the number of the bonus symbols is equal to or larger than a predetermined number, the right to execute the free game for a predetermined number of times is awarded. This encourages the player to be interested in the number of rearranged symbols. Furthermore, because the random determination of the number of times of execution of the free game is executed for a number of times corresponding to the number of the predetermined bonus symbols, the player enjoys the random determination for that number of times.

In the present invention, the gaming machine described above is arranged so that, the free game number random determination table used in the process (1D) defines that a winning probability of the number of times of execution of the bonus game varies in accordance with the number of the bonus symbol counted in the (1C).

According to the arrangement above, in accordance with the number of the bonus symbols rearranged when the right to run the free game is obtained, the winning probability of the number of times of execution of the free game randomly determined based on the free game number random determination table is varied. For example, the more the bonus symbols are rearranged when the right to run the free game is obtained, the higher the winning probability is, i.e., the more the number of times of execution of the bonus game is, as a result of the random determination based on the free game number random determination table. As such, the more the number of the bonus symbols rearranged when the right to run the free game is obtained, the more the player is advantageous.

In the present invention, the gaming machine described above is arranged so that, in the process (1D), a result of the random determination based on the free game number random determination table is notified each time the random determination is performed.

According to the arrangement above, a result of random determination of the number of times of execution of the free game based on the free game number random determination table is notified each time the random determination is executed.

With this, each time a result of the random determination is notified, the player pays attention to the awarded number of times of execution of the bonus game.

In the present invention, the gaming machine described above further executes the processes of:

(1G) as options, presenting the execution of the free game for the number of times awarded as a result of the random determination in the process (1F) and the execution of a one-time game with which the benefit is awarded as a result of random determination once; and (1H) executing the bonus game for the awarded number of times when the execution of the bonus game is chosen in the process (1G), or executing the one-time game when the execution of the one-time game is chosen in the process (1G).

This arrangement allows the player to select either the execution of the free game for the awarded number of times or the execution of the one-time game with which the benefit is awarded as a result of the random determination once.

With this arrangement, when, for example, the awarded total number of times of execution of the free game is large and it takes time to execute the free game for that number of times, the player may select the one-time game with which a benefit is awarded as a result of the random determination once, in order to shorten the time to run the free game for the awarded number of times.

In the present invention, the gaming machine described above is arranged so that, an expectation value of the benefit awarded in the one-time game is equal to a value calculated by multiplying the expectation value of the benefit awarded as a result of running the free game once by the awarded number of times of execution of the free game.

According to the arrangement above, because the expectation value of the payout awarded when the one-time game is selected is arranged to be equal to a value calculated by multiplying the expectation value of the benefit awarded by executing the free game once by the awarded number of times of execution of the free game, the payout to be awarded is mathematically identical between the case where the free game is executed for the awarded number of times and the case where the one-time game is selected. With this, no matter whether the execution of the free game is selected or the execution of the one-time game is selected, the player enjoys the game with the same expectation of the payout.

In the present invention, the gaming machine described above is arranged so that, in the process (1G), an estimated termination time which indicates when the execution of the free game for the awarded number of times ends is notified.

According to the arrangement above, the player is able to know an estimated termination time which indicates when the running of the free game for the awarded number of times ends. This allows the player to choose the execution of the free game for the awarded number of times or the execution of the one-time game, in consideration of the notified estimated termination time.

In the present invention, the gaming machine described above is arranged so that, when the number of times of execution of the free game awarded in the process (1F) is 100 or more, the process (1G) of, as options, presenting the execution of the free game for the number of times awarded as a result of the random determination in the process (1F) and the execution of a one-time game with which the benefit is awarded as a result of random determination once is executed.

According to the arrangement above, when the right to execute the free game 100 times or more, the player is allowed to choose the execution of the free game for the awarded number of times or the execution of the one-time game.

With this arrangement, when, for example, the awarded total number of times of execution of the free game is large and it takes time to execute the free game for that number of times, the player may select the one-time game with which a benefit is awarded as a result of the random determination once, in order to shorten the time to run the free game for the awarded number of times.

In the present invention, the gaming machine described above is arranged so that, the symbol display device displays the result of the game by displaying the symbols on reels and rearranging these reels, a random symbol is arranged on at least one of the reels, and each time the rearrangement of the reels starts, a symbol displayed in the random symbol is randomly determined.

According to this arrangement, a random symbol is displayed on at least one of the reels, and a symbol displayed in the random symbol is randomly determined before the start of the game.

With this, a combination of symbols which is likely to be achieved varies in each game. In other words, as a payout which is likely to be awarded is different each time the game is run, the game play is diversified and becomes more entertaining for the player.

The present invention relates to a method of controlling a gaming machine running a normal game and a bonus game developing from the normal game, the gaming machine including:

a symbol display device configured to display a result of a game by rearranging symbols;

a storage device configured to store a free game number random determination table in which the number of times of execution of a free game is associated with a random number; and a controller, the method comprising the steps of: under control of the controller, (2A) as a normal game, randomly selecting the symbols which are to be rearranged on the symbol display device;

(2B) rearranging the symbols selected in the step (2A) on the display device and awarding a benefit in accordance with a combination of the rearranged symbols;

(2C) when the benefit awarded in the step (2B) is the right to run the bonus game, counting how many predetermined bonus symbol is included in the combination of the symbols with which the right to run the bonus game is awarded;

(2D) performing random determination based on the free game number random determination table for the number of times corresponding to the number of the predetermined bonus symbol counted in the step (2C);

(2E) awarding the right to execute the free game for a predetermined number of times, when in the step (2C) the number of the predetermined bonus symbol is equal to or larger than the predetermined number;

(2F) as the number of times of execution of the free game, awarding the total number calculated by adding up the number of times of execution of the free game randomly determined in the step (2D) and the number of times of execution of the free game awarded in the step (2E).

According to the method above, in the normal game, when symbols are rearranged on the symbol display device and a benefit corresponding to the combination of the rearranged symbols is the right to run the bonus game, how many predetermined bonus symbol is included in the rearranged symbols is determined. The random determination is executed based on the bonus game number random determination table for the number of times corresponding to the number of the predetermined bonus symbol, and the number of times of execution of the bonus game is awarded to the player as a result of the random determination.

Furthermore, when the number of the predetermined bonus symbols in the combination of the rearranged symbols is equal to or larger than a predetermined number, the right to execute the free game for a predetermined number of times is further awarded.

According to this arrangement, when the right to execute the bonus game is obtained, the larger the number of the predetermined bonus symbols in the combination of the rearranged symbols is, the more frequently the random determination of the number of times of execution of the free game to be awarded is executed. Furthermore, when the number of the bonus symbols is equal to or larger than a predetermined number, the right to execute the free game for a predetermined number of times is awarded. This encourages the player to be interested in the number of rearranged symbols. Furthermore, because the random determination of the number of times of execution of the free game is executed for a number of times corresponding to the number of the predetermined bonus symbols, the player enjoys the random determination for that number of times.

It is possible to provide a gaming machine providing new forms of bonus awarding as a novel entertainment feature, and a control method of the gaming machine.

BRIEF DESCRIPTION OF THE DRAWINGS

FIG. 6 is an explanatory diagram of a symbol column on each video reel of the slot machine of First Embodiment.

FIG. 9 is an explanatory diagram of a payout determination table of First Embodiment.

FIG. 10 is an explanatory diagram of a bonus game number random determination table of First Embodiment.

FIG. 11 is an explanatory diagram of a roulette payout table of First Embodiment.

DESCRIPTION OF THE PREFERRED EMBODIMENTS (Outline of Slot Machine 10)

Figure 1:
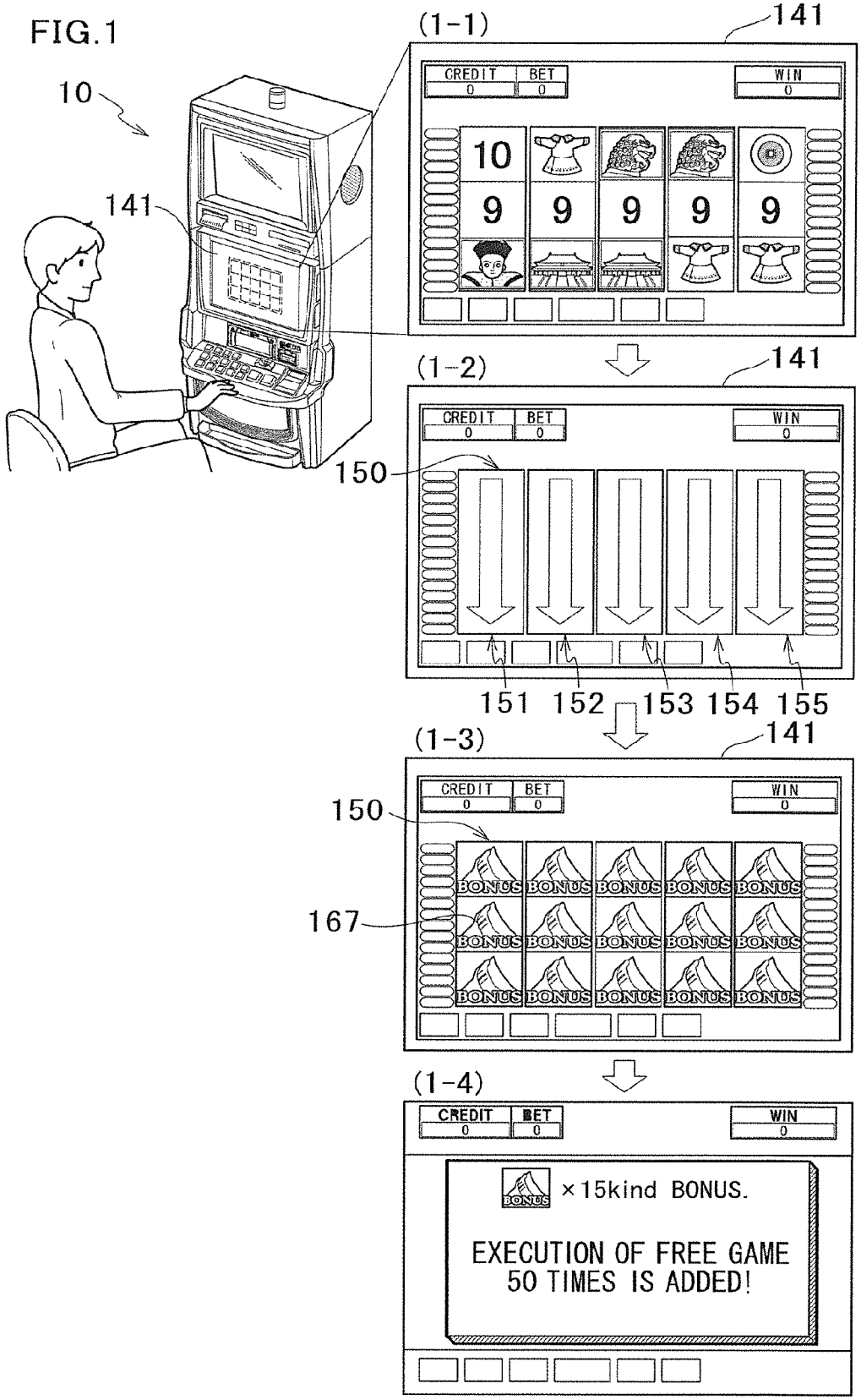
FIG. 1 is an explanatory diagram providing an overview of a slot machine game of one embodiment.
Figure 22:
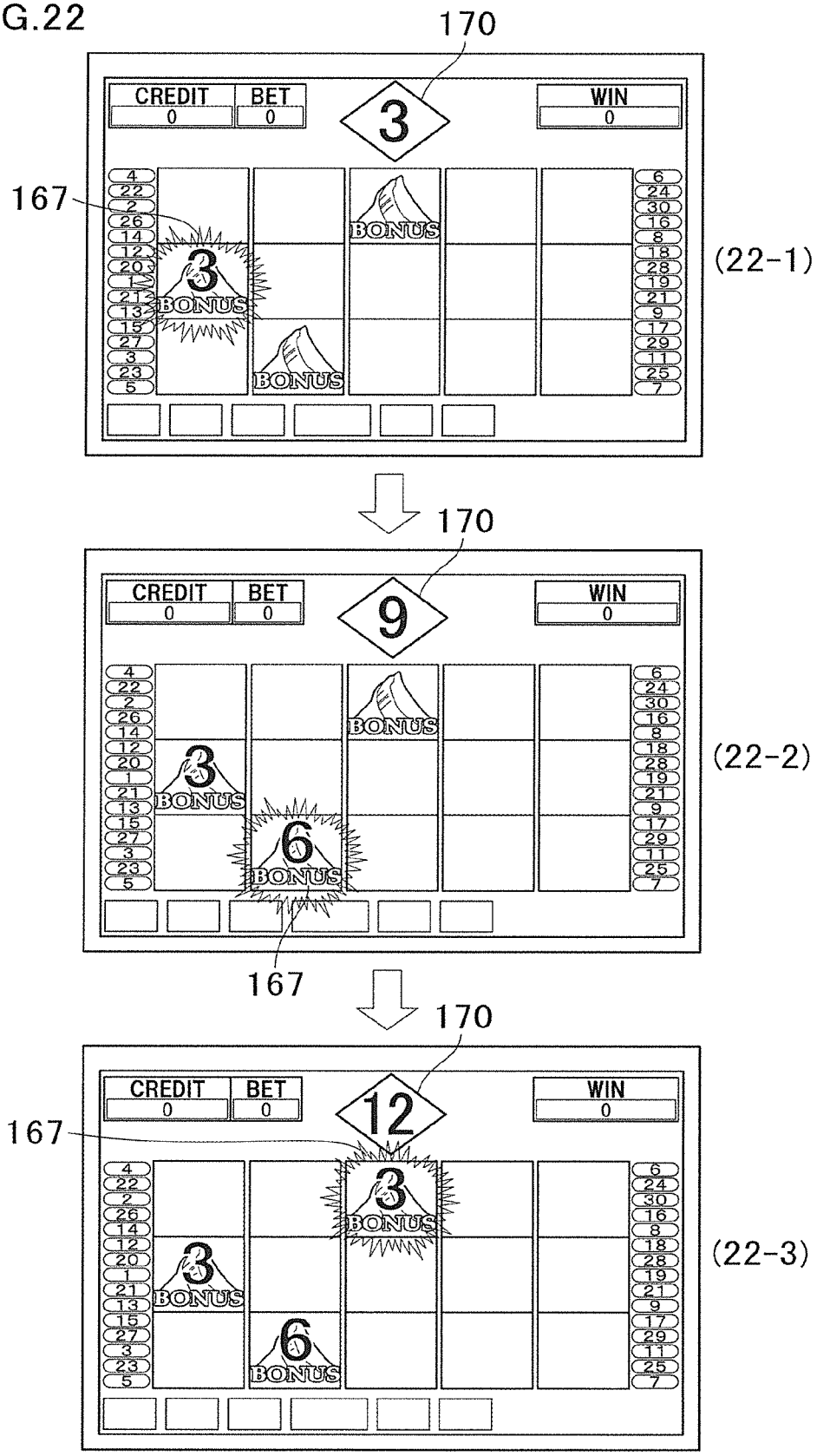
FIG. 22 shows an example of an image displayed on the lower image display panel in the bonus game process.

As shown in FIG. 1, a slot machine 10 according to the present invention includes a lower image display panel 141 (symbol display device) configured to display a result of a game by rearranging symbols, a RAM 73 (storage device) configured to store a free game number random determination table 192 in which the awarded number of times of execution of a free game is associated with a random number, a motherboard 70, and a main CPU 71 (controller). The main CPU 71 is configured to execute the following processes of:

(1A) as a normal game, randomly selecting symbols to be rearranged on the lower image display panel 141;

(1B) rearranging the symbols selected in the process (1A) on the lower image display panel 141 (see FIG. 19) and awarding a benefit in accordance with the combination of the rearranged symbols;

(1C) when the benefit awarded in the process (1B) is the right to execute a bonus game, counting how many BONUS symbols 167 are included in the combination of the symbols with which the right to execute the bonus game is awarded;

(1D) performing random determination based on the free game number random determination table 192 for a number of times corresponding to the number of the BONUS symbols 167 counted in the process (1C) (see FIG. 22);

(1E) when the number of the BONUS symbols 167 counted in the process (1C) is 15, awarding the right to execute the free game 50 times (see (1-1) to (1-4) in FIG. 1);

(1F) as the number of times of execution of the free game, awarding a number calculated by adding up the total awarded number of times of execution of the free game randomly determined in the process (1D) and the number of times of execution of the free game awarded in the process (1E).

(Definitions or the Like)

The slot machine 10 above is a type of a gaming machine. While the present embodiment deals with the slot machine 10 as an example of the gaming machine, the slot machine 10 may be a different type of machine on condition that a normal game can be individually run by the machine and a bonus game developing from the normal game can be run by the machine.

A normal game of the present embodiment is run by the slot machine 10. The normal game is a slot game of rearranging symbols (see FIG. 6). The normal game is a concept as opposed to a free game, a bonus game, and a roulette game.

The rearrangement of the symbols in the slot game is performed on the lower image display panel 141. The slot game includes a process of running a normal game of rearranging symbols on the lower image display panel 141 on condition that a gaming value is bet and awarding a normal payout based on the rearranged symbols and a process of running a free game of rearranging symbols in a condition different from that of the normal game when the symbols rearranged in the normal game achieve a predetermined condition and awarding a payout based on the rearranged symbols.

As the symbols, there are "J", "Q", "9", "A", "10", "CURRENCY 161", "DRESS" 162, "DRAGON" 163, "CASTLE" 164, "EMPEROR" 165, "WILD" 166, "BONUS" 167, and "BOX SYMBOL 168".

A coin, a bill, or electrically valuable information corresponding to these is used as a gaming value. It is to be noted that the gaming value in the disclosure is not limited to these, and for example a medal, a token, electric money or the like can be adopted. Further, a later-described ticket with a barcode is also used.

The bonus game of the present embodiment may be of any type on condition that the gaming state thereof is different from that of the normal game. In the present embodiment, a free game or a roulette game (one-time game) is executed as the bonus game. The free game is a game which is executable with a smaller amount of gaming values bet than in the normal game. The expression "executable with a smaller amount of gaming value bet" includes a case where an amount of gaming values bet is zero. Therefore, the free game may be a game which is run without betting a gaming value and the gaming value is paid out for an amount corresponding to rearranged symbols. In other words, the free game may be a game that starts even if no gaming value is consumed. On the other hand, the normal game is run on condition that a gaming value is bet, and is a game of paying out a gaming value for an amount corresponding to rearranged symbols. In other words, the normal game is a game that starts with the consumption of the gaming value. The roulette game in the present embodiment is a game in which a payout is randomly determined based on a winning probability associated with each payout. The roulette game as a one-time game may be of any type on condition that a benefit is awarded as a result of random determination once.

The term "rearrangement" indicates that the symbols are rearranged after the arrangement of the symbols is dismissed. The term "arrangement" indicates a state in which the symbols are visually recognizable by an external player.

(Explanation of Function Flow Diagram)

Figure 2:
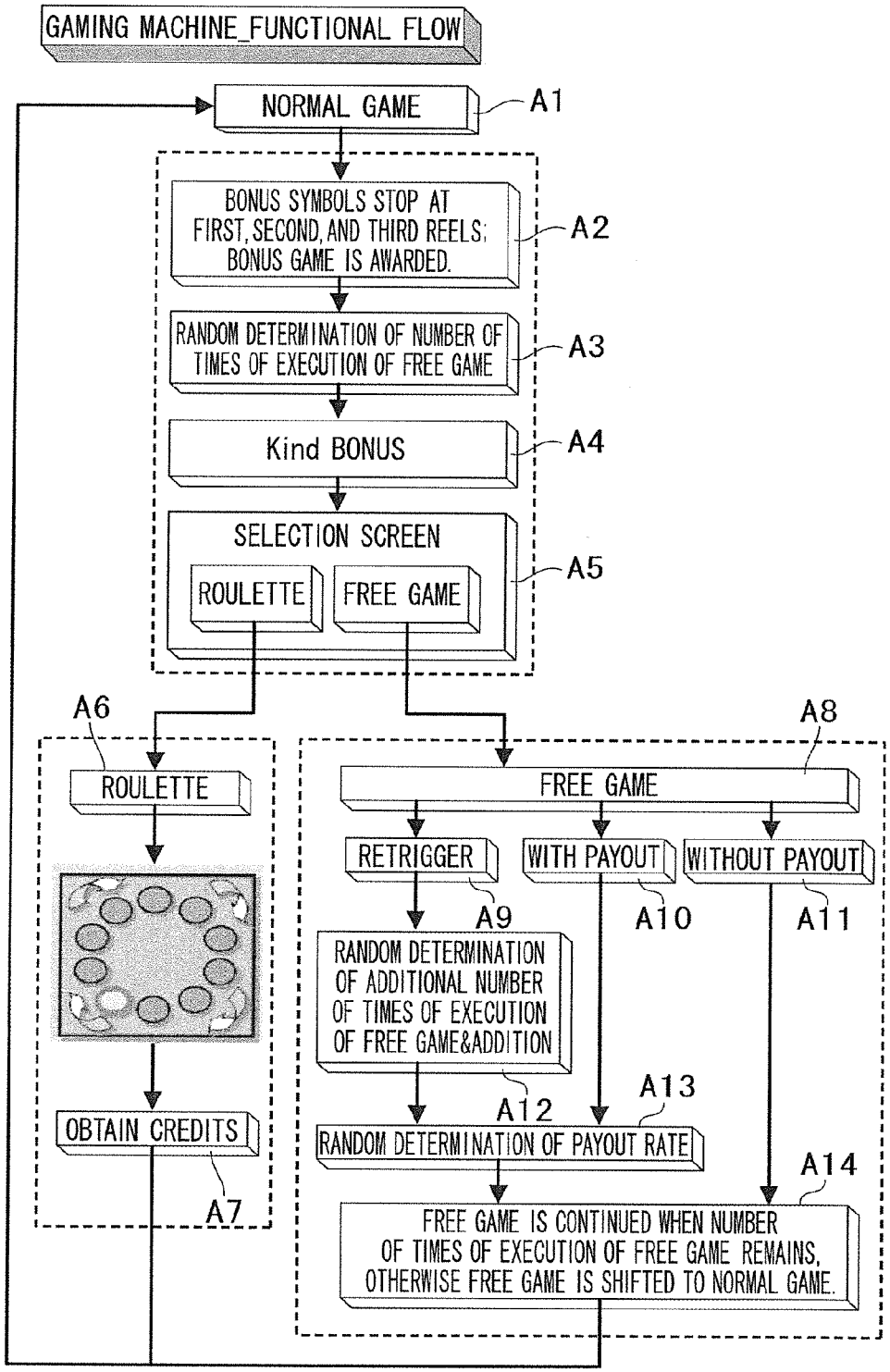
FIG. 2 is a diagram showing a function flow of the gaming machine of the present invention.

The following describes basic functions of the slot machine 10 of the present invention, with reference to FIG. 2.

(Normal Game)

To begin with, in the slot machine 10, a slot game of rearranging symbols is run as a normal game, and a benefit is awarded in accordance with the combination of the rearranged symbols (A1).

Subsequently, when in the normal game at least one symbol BONUS 167 is rearranged on a display block 28 of each of a first video reel 151, a second video reel 152, and a third video reel 153, bonus game trigger is established and a bonus game is awarded (A2).

Then the random determination of the number of times of execution of the free game is conducted for the number of times corresponding to the number of the BONUS 167 symbols in the symbol combination at the time of the establishment of the bonus game trigger (A3).

Subsequently, when 15 BONUS symbols 167 are displayed on the display blocks 28 of the lower image display panel 141 at the time of the establishment of the bonus game trigger in (A2), the right to execute the free game 50 times is awarded as a 15-Kind bonus (A4).

Then the player is prompted to select the execution of the free game for the awarded number of times or the execution of a roulette game in which a payout may be awarded as a result of one random determination (A5).

Figure 32:
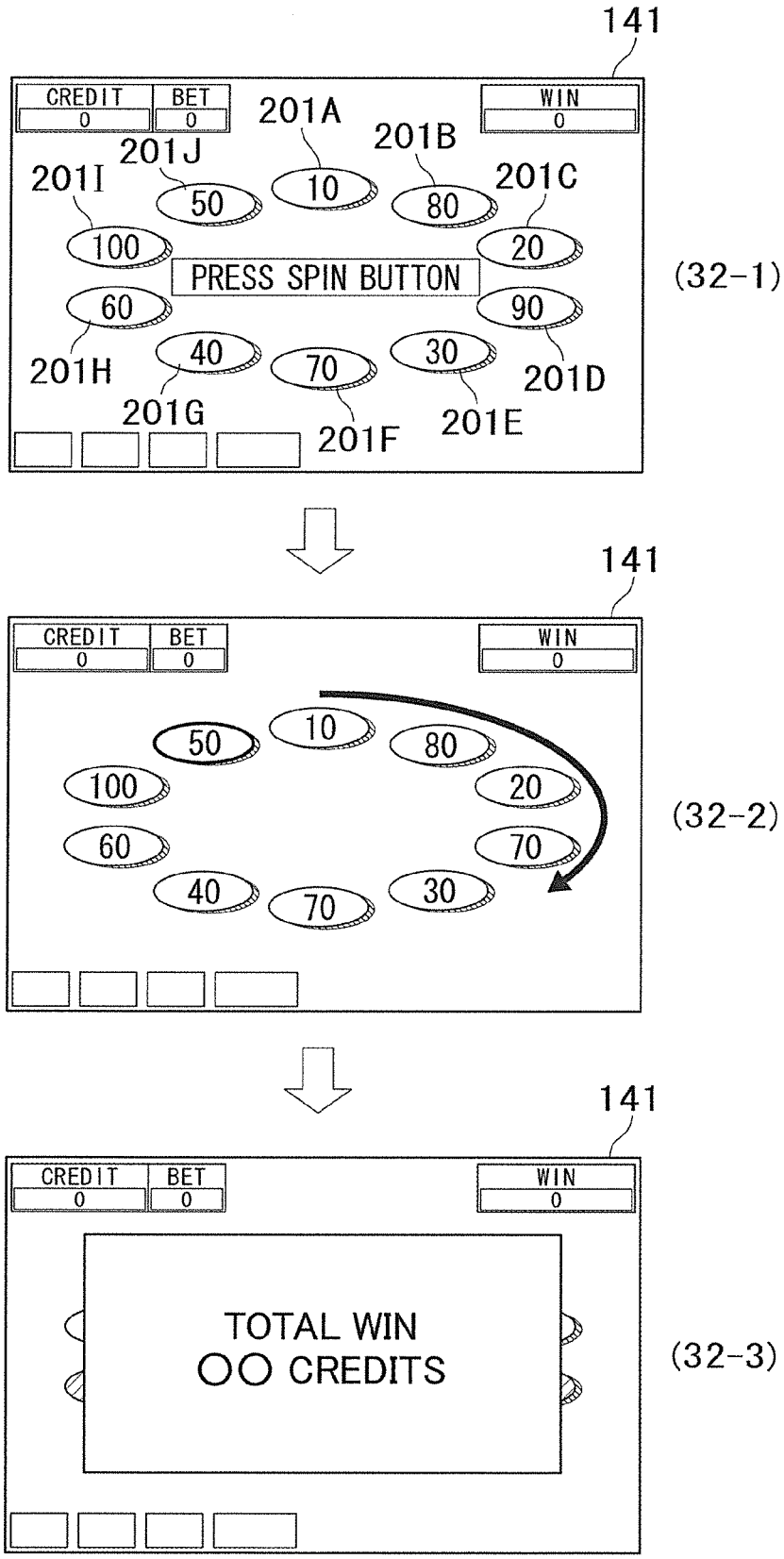
FIG. 32 shows an example of an image displayed on the lower image display panel in a roulette running process.

When the roulette game is selected in A5, as shown in FIG. 32, an effect is displayed such that a light spot rotates clockwise on targets 201A to 201J and then stops on the randomly selected one of the targets 201A to 201J after gradually slows down (A6).

A payout credit corresponding to the one of the targets 201A to 201J where the light spot stops in A6 is awarded to the player (A7). Then the process shifts to the normal game.

On the other hand, when the free game is selected in A5, the slot game is run in the same manner as in the normal game (A8). Based on the combination of the rearranged symbols, a payout is awarded if there is a payout (A10), no payout is awarded if there is no payout (A11), and the process of randomly determining and adding the additional number of times of execution of the free game is conducted (A12) if re-trigger is established (A9). When there is a payout in the free game, the payout rate of the payout is randomly determined (A13). Thereafter, when the number of times of execution of the free game is not zero, the execution of the free game is continued. When the number of times of execution of the free game is zero, the process proceeds to the normal game (A14).

(Structure of Slot Machine 10)

Next, the following describes a gaming system including a slot machine 10 to which the gaming machine of the present invention is applied. Next, with reference to FIG. 3 and FIG. 4, the following describes an overall structure of the slot machine 10.

A coin, a bill, or electrically valuable information corresponding to these is used as a game medium in the slot machine 10. Further, in the present embodiment, a later-described ticket with a barcode is also used. It is to be noted that the game medium is not limited to these, and for example a medal, a token, electronic money or the like can be adopted.

The slot machine 10 includes a cabinet 11, a top box 12 installed on the upper side of the cabinet 11, and a main door 13 provided at the front surface of the cabinet 11.

(Structure of Slot Machine 10: Image Displayed on Lower Image Display Panel 141)

On the main door 13, a lower image display panel 141 (equivalent to a symbol display device) is provided. The lower image display panel 141 is formed of a transparent liquid crystal panel. The lower image display panel 141 is formed of a transparent liquid crystal panel. The display window 150 includes fifteen display blocks 28 which are arranged in five columns and three rows. The columns form video reels 151 to 155, each having three display blocks 28. The three display blocks 28 in each of the video reels 151 to 155 are displayed as if all the display blocks 28 are moving downward at various speed. This enables rearrangement, in a manner that symbols respectively displayed in the display blocks 28 are rotated in a longitudinal direction and stopped thereafter.

Figure 7:
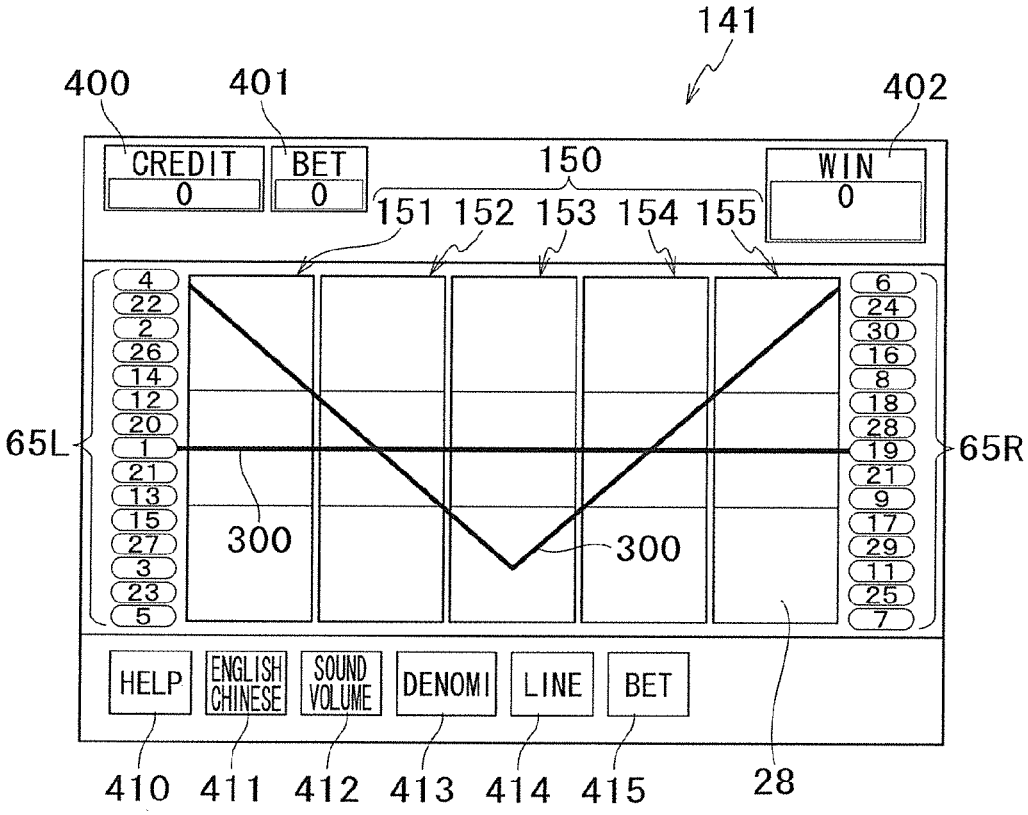
FIG. 7 is an explanatory diagram of an image displayed on a lower image display panel of the slot machine of First Embodiment.
Figure 8:
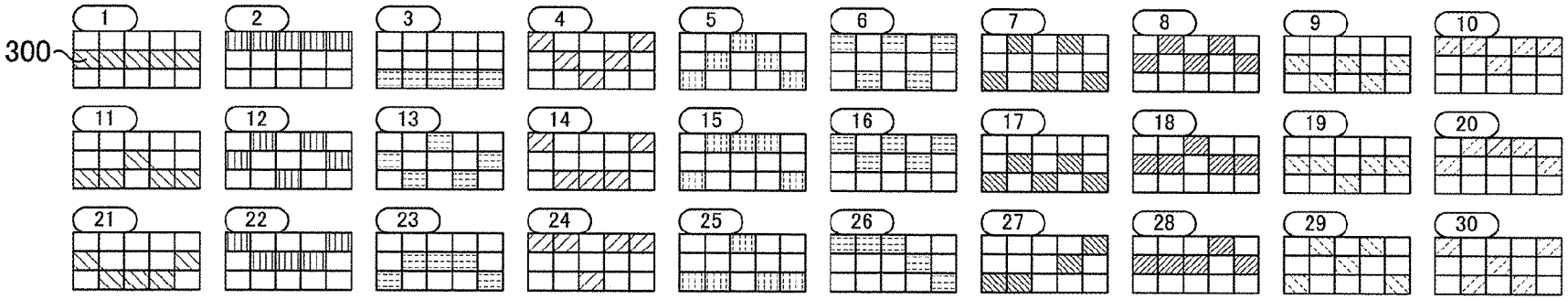
FIG. 8 is an explanatory diagram showing paylines related to First Embodiment.

In addition to the above, as shown in FIG. 7 and FIG. 8, on the left and right sides of the display window 150 displayed on the lower image display panel 141 are symmetrically arranged payline occurrence columns. The payline occurrence column on the left side for the player includes fifteen payline occurrence parts 65L (see the paylines 300 each of which is a combination of display blocks 28 in FIG. 8). On the other hand, the payline occurrence column on the right side has fifteen payline occurrence parts 65R (see the paylines 300 each of which is a combination of display blocks 28 in FIG. 8). The payline occurrence parts 65L and the payline occurrence parts 65R form a total of 30 paylines 300, as shown in FIG. 7 and FIG. 8.

The number of active paylines 300 is determined based on an operation of a 1-bet button 34, a 2-bet button 35, a 3-bet button 37, a 4-bet button 38, a 5-bet button 39, a max bet button 45, a play-2-lines button 40, a play-10-lines button 41, a play-20-lines button 42, and a play-30-lines button 43 on a later-described control panel 30. An activated payline 300 results in various types of winning for each symbol.

Above the display window 150, as shown in FIG. 7, a credit meter 400, a bet meter 401, and a win meter 402. The credit amount display unit 400 and the bet-number display unit 401 are displayed at the left edge part when viewed from the player. In the meanwhile, the win meter 402 is provided at the right edge part when viewed from the player.

The credit meter 400 displays the total number of credits. The default value is 0. The number increases or decreases in accordance with the insertion of a game value, betting, or a game result.

The bet meter 401 displays "Total Bets (=Bets×Lines)". The value is re-calculated in each game play. The win meter 402 displays the total obtained credits in an increment manner. The default value is 0. The win meter 402 switchably displays "Line XX Win XX" or "Total Win XX". The display is switched in sync with the display of payline at the time of the occurrence of winning. The content above is displayed after the occurrence of winning. The values are determined based on the payline at the occurrence of winning and the number of credits.

In the meanwhile, below the display window 150 are provided a help touch button 410, a language switching touch button 411, a sound volume switching touch button 412, a denomination button 413, a number of lines selection touch button 414, and a bet per line selection touch button 415. These buttons 410, 411, 412, 413, 414, and 415 are provided left to right when viewed from the player.

The help touch button 410 displays a help screen when touched. The help touch button 410 is darkened when it is inactivated, e.g., during the rotation of the reels. The button is displayed when the normal screen is displayed.

The help touch button 410 displays a help screen when touched. The help touch button 410 is darkened when it is inactivated, e.g., during the rotation of the reels. The button is displayed when the normal screen is displayed.

The sound volume switching touch button 412 is used for switching the game sound volume at three stages. Each time the button is touched, the game sound volume is switched such that, for example, from low to middle to high to small to middle. The button is displayed when the normal screen is displayed.

The denomination button 413 displays the current denomination set in the AUDIT. This button is displayed when screens other than the AUDIT are displayed.

The number of lines selection touch button 414 is used for increasing or decreasing the number of paylines L.

The bet per line selection touch button 415 makes it possible to conduct bet per line. When the button is touched, five selection buttons corresponding to the current bet configuration appear.

Further, a touch panel 114 is disposed on a front surface of the lower image display panel 141, and a player is able to input various instructions by operating the touch panel 114. From the touch panel 114, an input signal is transmitted to the main CPU 71.

Figure 3:
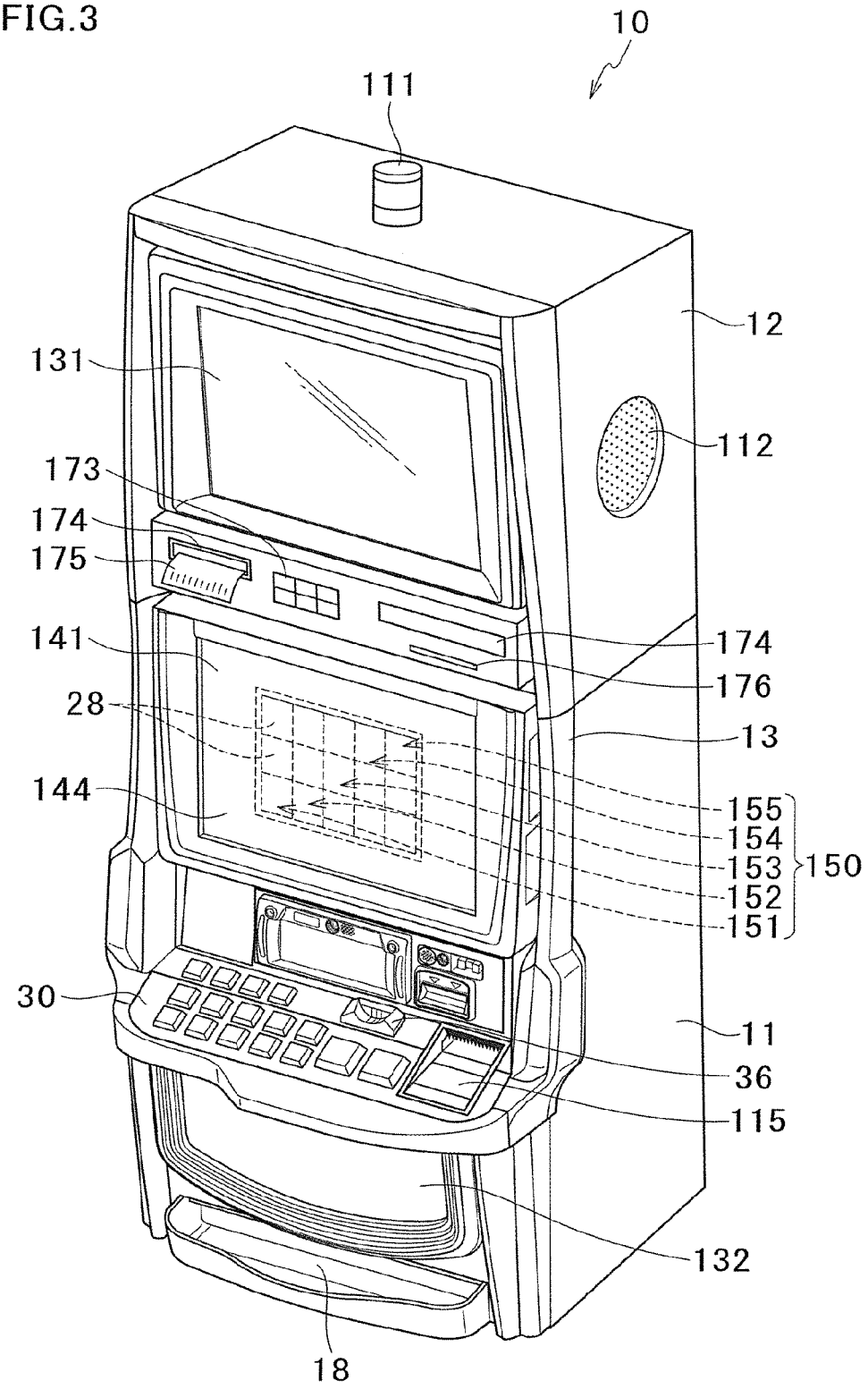
FIG. 3 shows the entire structure of the slot machine of the embodiment.
Figure 4:
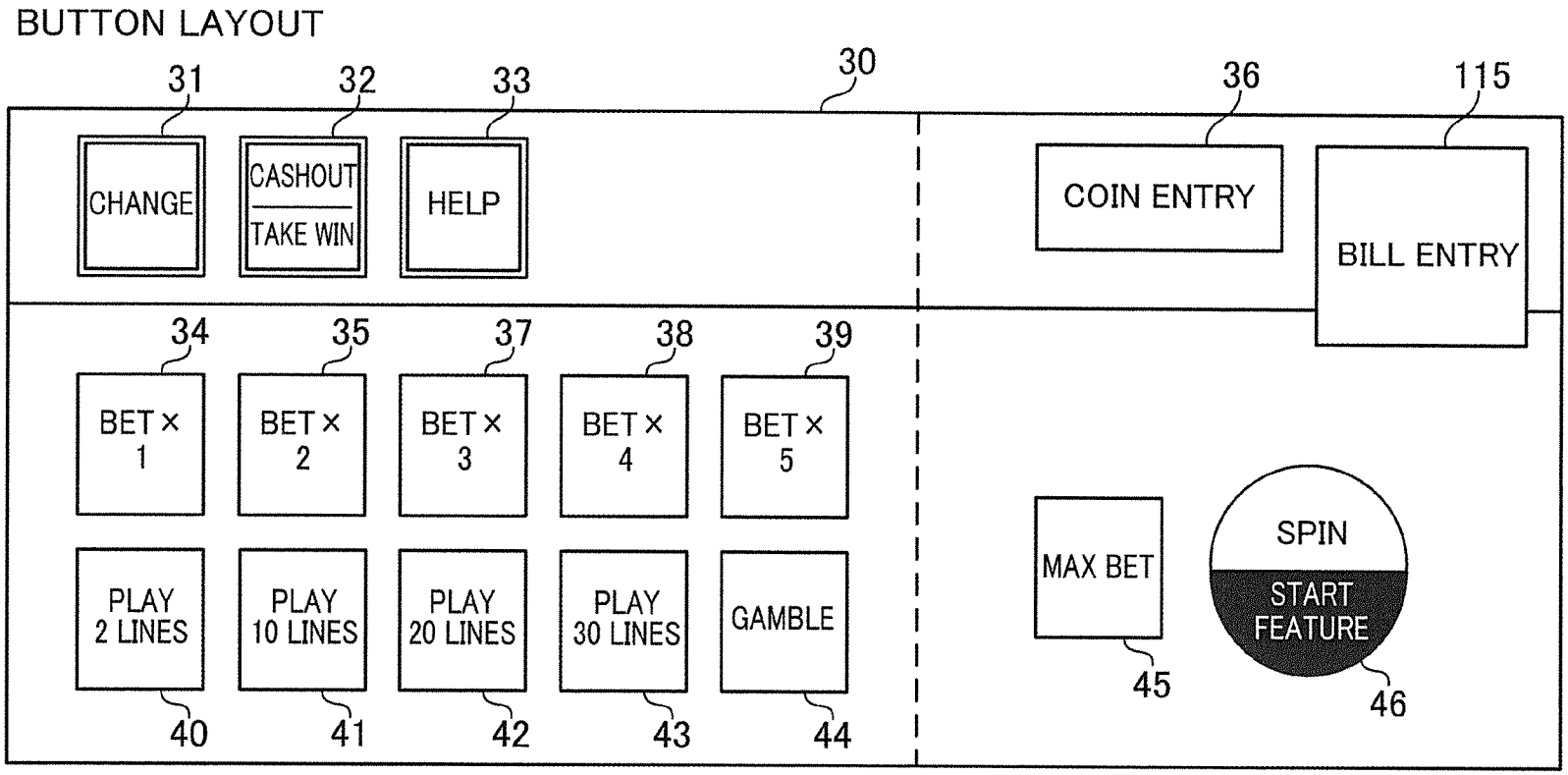
FIG. 4 shows a control panel of the slot machine of the embodiment.

As shown in FIG. 3 and FIG. 4, below the lower image display panel 141 are provided various buttons on the control panel 30 (input device), a coin entry 36 which guides coins into the cabinet 11, and a bill entry 115.

The control panel 30 includes: a change button 31, a cashout/take win button 32, and a help button 33 arranged in the left side area of the upper stage; a 1-bet button 34, a 2-bet button 35, a 3-bet button 37, a 4-bet button 38, a 5-bet button 39, a play-2-lines button 40, a play-10-lines button 41, a play-20-lines button 42, a play-30-lines button 43, and a gamble button 44 in the left side area of the lower stage. Further, a coin entry 36 and a bill entry 115 for accepting bills or the like are arranged in the right side area of the upper stage, and a max-bet button 45 and a spin button 46 are arranged in the right side area of the lower stage.

The change button 31 is an operation button to be used when temporarily leaving the seat, or when requesting a staff person of the gaming facility for an exchange. The cashout/take win button 32 is an operation button to be used for cashing out coins (credits) stored in the slot machine 10. The help button 33 is pressed when the operating method of a game is unclear. When the help button 33 is pressed, various types of help information are displayed on the upper image display panel 131 and the lower image display panel 141.

A 1-bet button 34 is arranged so that, each time the button is pressed, one gaming medium is bet on each active payline from the current credit owned by the player. A 2-bet button 35 is pressed to start a game on condition that two gaming media are bet on each active payline. A 3-bet button 37 is pressed to start a game on condition that three gaming media are bet on each active payline. A 4-bet button 38 is pressed to start a game on condition that four gaming media are bet on each active payline. A 5-bet button 39 is pressed to start a game on condition that five gaming media are bet on each active payline. A max-bet button 45 is pressed to start a game on condition that ten gaming media are bet on each active payline. Thus, the bet amount on each payline is determined by pressing of the 1-bet button 34, the 2-bet button 35, the 3-bet button 37, the 4-bet button 38, the 5-bet button 39, and the max-bet button 45.

A play-2-lines button 40 activates paylines when pressed. In this case, the number of paylines to be activated is 2. A play-10-lines button 41 activates paylines when pressed. In this case, the number of paylines to be activated is 10. A play-20-lines button 42 activates paylines when pressed. In this case, the number of paylines to be activated is 20. A play-30-lines button activates paylines when pressed. In this case, the number of paylines to be activated is 30.

The gamble button 44 is an operation button used for, for example, shifting to the gamble game after the end of the bonus game or the like. The gamble game here means a game run by using credit the player has won.

The spin button 46 is a button for starting scroll of the video reels 151 to 155.

The coin entry 36 is for accepting coins into the cabinet 11. The bill entry 115 validates a bill, and accepts a valid bill into the cabinet 11.

Further, the lower front surface of the main door 13, i.e., the lower portion of the control panel 30, has a belly glass 132 on which a character of the slot machine 10 or the like is drawn, and a coin tray 18 for receiving coins output from inside the cabinet 11.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 10 produces effects by displaying images, outputting sounds, and outputting the light.

A data display 174, and a keypad 173 are provided on the lower side of the upper image display panel 131. The data display 174 includes a fluorescent display, LEDs and the like, and displays the data inputted by the player via the keypad 173, for example. The keypad 173 is for inputting data.

(Symbol Column)

Next, with reference to FIG. 6, a configuration of the symbol columns on the video reels 151-155 of the slot machine 10 is described.

The base game symbol table of FIG. 6 shows arrangements of symbols displayed on the video reels. A first video reel 151, a second video reel 152, a third video reel 153, a fourth video reel 154, and a fifth video reel 155 each is assigned with a symbol column consisting of 22 symbols that correspond to respective code numbers from "00" to "21".

As the symbols, there are "J", "Q", "9", "A", "10", "CURRENCY" 161, "DRESS" 162, "DRAGON" 163, "CASTLE" 164, "EMPEROR" 165, "WILD" 166, "BONUS" 167, and "BOX SYMBOL" 168, as shown in FIG. 6. The box symbol 168 is equivalent to a random symbol where a randomly-determined symbol is displayed in each game, as detailed later.

(Structures of Circuits Provided to Slot Machine 10)

Figure 5:
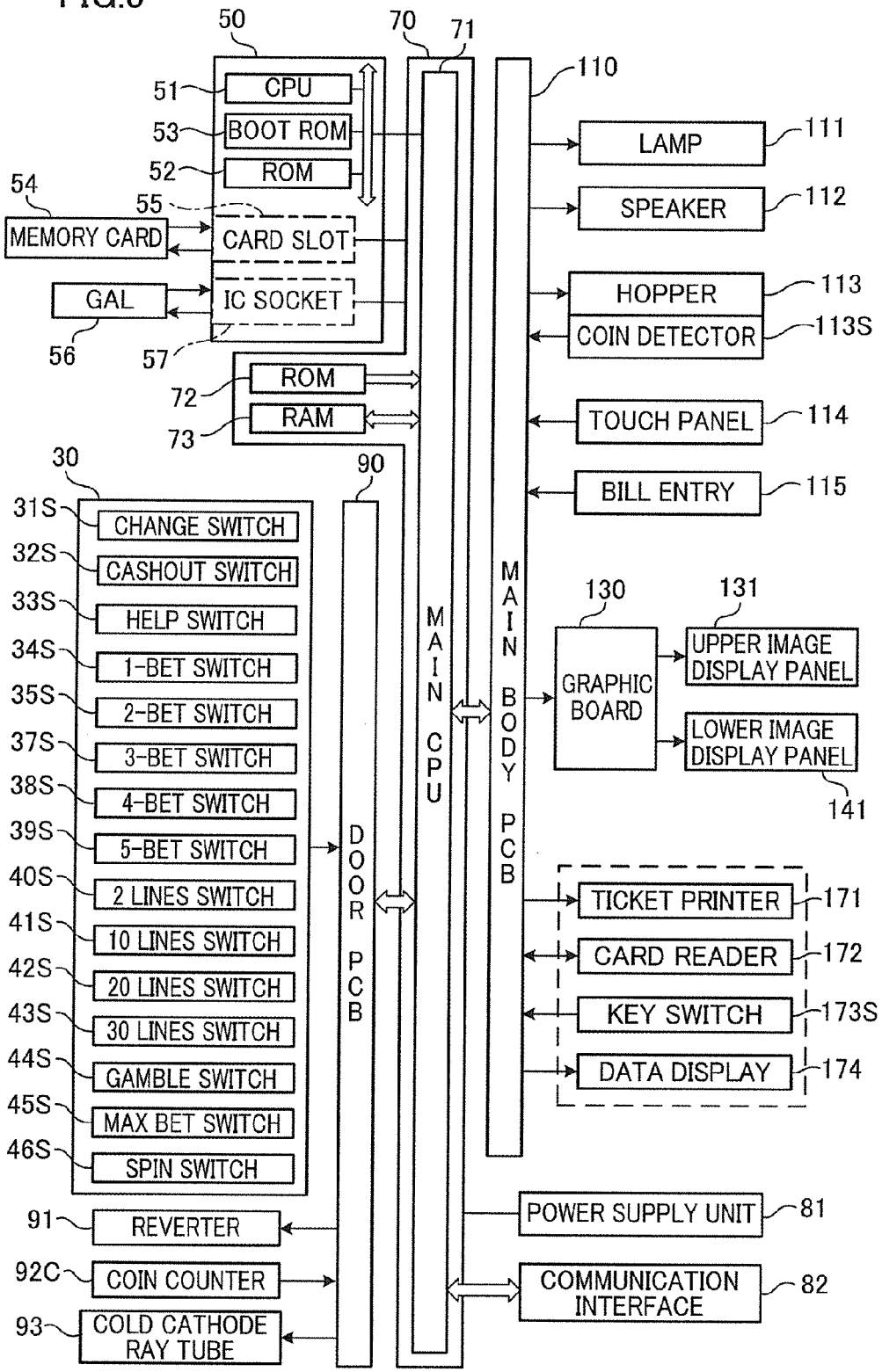
FIG. 5 is a block diagram showing an internal structure of the slot machine of the embodiment.

Next, with reference to FIG. 5, a configuration of a circuit included in the slot machine 10 is described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds. The game program further includes data of a symbol table by which the arrangement of symbols on each of the video reels 151 to 155 is determined, a payout determination table 191, a bonus game number random determination table 192, and a roulette payout table 193.

The random determination program is a program for randomly determining to-be stopped symbol on the video reels 151-155. The to-be stopped symbol is data for determining three symbols to be displayed to the display window 150 out of the 22 symbols forming each symbol column. The slot machine 10 of the present embodiment determines as the to-be stopped symbol the symbols to be displayed in a predetermined area (e.g. the uppermost stage) out of the three areas provided for each of the video reels 151-155 of the display window 150.

The aforementioned random determination program includes symbol determination data. The symbol determination data is data that specifies random numbers so that each of the 22 symbols (code numbers from "00" to "21") forming the symbol column is determined at an equal probability (i.e. 1/22), for each of the video reels 151-155. The probabilities of the respective 22 symbols being determined are basically equal. However, the types of symbols included in the 22 symbols are different from one another in number, and thus the probabilities of the respective types of symbols being determined are different. It is noted that the probabilities of the respective types of symbols may include a random number.

Further, the card slot 55 is configured so that the memory card 54 can be inserted thereinto and removed therefrom, and is connected to a motherboard 70 by an IDE bus.

The GAL 56 is a type of PLD (programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72 (storage device), a RAM 73 (storage device), and a communication interface 82. The motherboard 70 corresponds to the controller of the present invention.

The ROM 72 includes a memory device such as a flash memory, and stores a program such as BIOS to be executed by the main CPU 71, and permanent data. When the BIOS is executed by the main CPU 71, a process for initializing predetermined peripheral devices is executed. Further, through the gaming board 50, a process of loading the game program and the game system program stored in the memory card 54 is started.

The RAM 73 stores data and programs which are used in operation of the main CPU 71. For example, when the process of loading the aforementioned game program (including the payout determination table 191, the bonus game number random determination table 192, and roulette payout table 193), game system program or authentication program is executed, the RAM 73 can store the program.

The RAM 73 is provided with working areas used for operations in execution of these programs. Examples of the areas include: an area that stores counters for the number of games, the bet amount, the payout amount, the credit amount and the like; and an area that stores symbols (code numbers) randomly determined. In other words, the RAM 73 functions as a game counter, a bet amount counter, a payout amount counter, and a credit amount counter.

The communication interface 82 is for communicating with the external controller such as a server, through the communication line. Further, the motherboard 70 is connected with a later-described door PCB (Printed Circuit Board) 90 and a main body PCB 110 by respective USBs.

The motherboard 70 is also connected with a power unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 includes: a change switch 31S, a cashout switch 32S, a help switch 33S, a 1-bet switch 34S, a 2-bet switch 35S, a 3-bet switch 37S, a 4-bet switch 38S, a 5-bet switch 39S, a play-2-lines switch 40S, a play-10-lines switch 41S, a play-20-lines switch 42S, a play-30-lines switch 43S, a gamble switch 44S, a max-bet switch 45S, and a spin switch 46S, which correspond to the above described buttons, respectively. Each of the switches outputs a signal to the main CPU 71 upon detection of the pressing of the button corresponding thereto by the player.

Inside the coin entry 36 is provided a reverter 91 and a coin counter 92C. The reverter 91 validates the legitimacy of coins inserted into the coin entry 36, and outputs those not determined as genuine coins to the coin tray 18. The coin counter 92C detects the received genuine coins and counts the number of these coins.

The cold cathode tube 93 functions as a backlight installed on the rear face side of the upper image display panel 131 and the lower image display panel 141, and turns on based on a control signal outputted from the main CPU 71.

To the main body PCB 110 are connected the lamp 111, the speaker 112, a hopper 113, a coin detection unit 113S, the touch panel 114, the bill entry 115, a graphic board 130, a ticket printer 171, a card reader 172, a key switch 173S and the data display 174.

The lamp 111 turns on based on a control signal outputted from the main CPU 71. The speaker 112 outputs sounds such as BGM, based on a control signal outputted from the main CPU 71.

The hopper 113 operates based on a control signal outputted from the main CPU 71, and pays out a designated number of coins to the coin tray 18. The coin detection unit 113S outputs a signal to the main CPU 71 upon detection of coins paid out by the hopper 113.

The touch panel 114 detects a place on the lower image display panel 141 touched by the player's finger or the like, and outputs to the main CPU 71 a signal corresponding to the detected place. Upon acceptance of a valid bill, the bill entry 115 outputs to the main CPU 71 a signal corresponding to the face amount of the bill.

The graphic board 130 controls image display executed by the respective upper image display panel 131 and lower image display panel 141, based on a control signal outputted from the main CPU 71. The display window 150 of the lower image display panel 141 displays the five video reels 151-155 by which the scrolling and stop motions of the symbol columns included in the respective video reels 151-155 are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the credit amount stored in the RAM 73, date and time, the identification number of the slot machine 10, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

(Payout Determination Table)

Next, the following describes a payout determination table, with reference to FIG. 9.

The payout determination table 191 indicates a relation between a credit amount paid out and the type of and the number of symbols rearranged on an active payline 300. Note that the payout determination table 191 is read out and referred to in a later mentioned program. In the present embodiment, rearrangement of three or more of at least one of the following types of symbols on an active payline 300 is determined as a winning: "J", "Q", "9", "A", "10", "CURRENCY", "DRESS", "DRAGON", "CASTLE", "EMPEROR", and "WILD".

As detailed later, when at least one symbol "BONUS 167" (equivalent to the bonus symbol) which is a trigger symbol of the bonus game is arranged in the display block 28 of each of the first video reel 151, the second video reel 152, and the third video reel 153, "bonus game trigger" (equivalent to the right to run the bonus game) is achieved as a winning combination, and the process proceeds to the bonus game.

(Bonus Game Number Random Determination Table)

Now, referring to FIG. 10, the free game number random determination table 192 will be described.

The free game number random determination table 192 is a random determination table which is read and referred to during a later-described bonus game process, and indicates winning probabilities of the obtained numbers of times of execution of the free game (see the columns in the free game number random determination table 192 shown in FIG. 10) corresponding to the numbers of the bonus symbols 167 displayed on the display window 150 (see the rows in the free game number random determination table 192 shown in FIG. 10) when bonus game trigger is established during a later-described main control process. For example, when the bonus game trigger is established in the main control process and three bonus symbols 167 are displayed in the display window 150 in total, a "Very_Low" random determination table in the free game number random determination table 192 is referred to in the bonus game process. In this case, the number of times of execution of the free game "three times" is awarded at a probability of 50/100, "six times" is awarded at a probability of 30/100, "nine times" is awarded at a probability of 10/100, "twelve times" is awarded at a probability of 7/100, "fifteen times" is awarded at a probability of 2/100, and "thirty times" is awarded at a probability of 1/100. In the present embodiment, as indicated by the free game number random determination table 192 shown in FIG. 10, the winning probabilities are set so that, when the bonus game trigger is established in the main control process, the awarded number of times of running the free game increases as the number of the bonus symbols 167 displayed in the display window 150 increases. More specifically, six random determination tables "Very_Low", "Low", "Middle", "High", "Very_High", and "EXTRA" are set in accordance with the numbers of the bonus symbols 167 displayed in the display window 150, and hence the player's expectation on the number of times of running the free game to be awarded increases in accordance with the increase in the number of the bonus symbols 167 displayed in the display window 150.

(Roulette Payout Table)

Now, referring to FIG. 11, the roulette payout table 193 will be described.

The roulette payout table 193 is payout data read out and referred to during a later-described roulette running process, and shows winning probabilities of the payout corresponding to targets 201A to 201J which are displayed during the later-described roulette running process, as shown in FIG. 32.

More specifically, as shown in FIG. 11, the target 201A is associated with a payout of "10 credits" and the winning probability thereof is set at 10/71. The target 201B is associated with a payout of "80 credits" and the winning probability thereof is set at 4/71. The target 201C is associated with a payout of "20 credits" and the winning probability thereof is set at 10/71. The target 201D is associated with a payout of "90 credits" and the winning probability thereof is set at 3/71. The target 201E is associated with a payout of "30 credits" and the winning probability thereof is set at 10/71. The target 201F is associated with a payout of "70 credits" and the winning probability thereof is set at 4/71. The target 201G is associated with a payout of "40 credits" and the winning probability thereof is set at 10/71. The target 201H is associated with a payout of "60 credits" and the winning probability thereof is set at 6/71. The target 201I is associated with a payout of "100 credits" and the winning probability thereof is set at 5/71. The target 201J is associated with a payout of "50 credits" and the winning probability thereof is set at 9/71.

(Contents of Program)

Next, the program to be executed by the slot machine 10 is described.

(Main Control Process)

Figure 12:
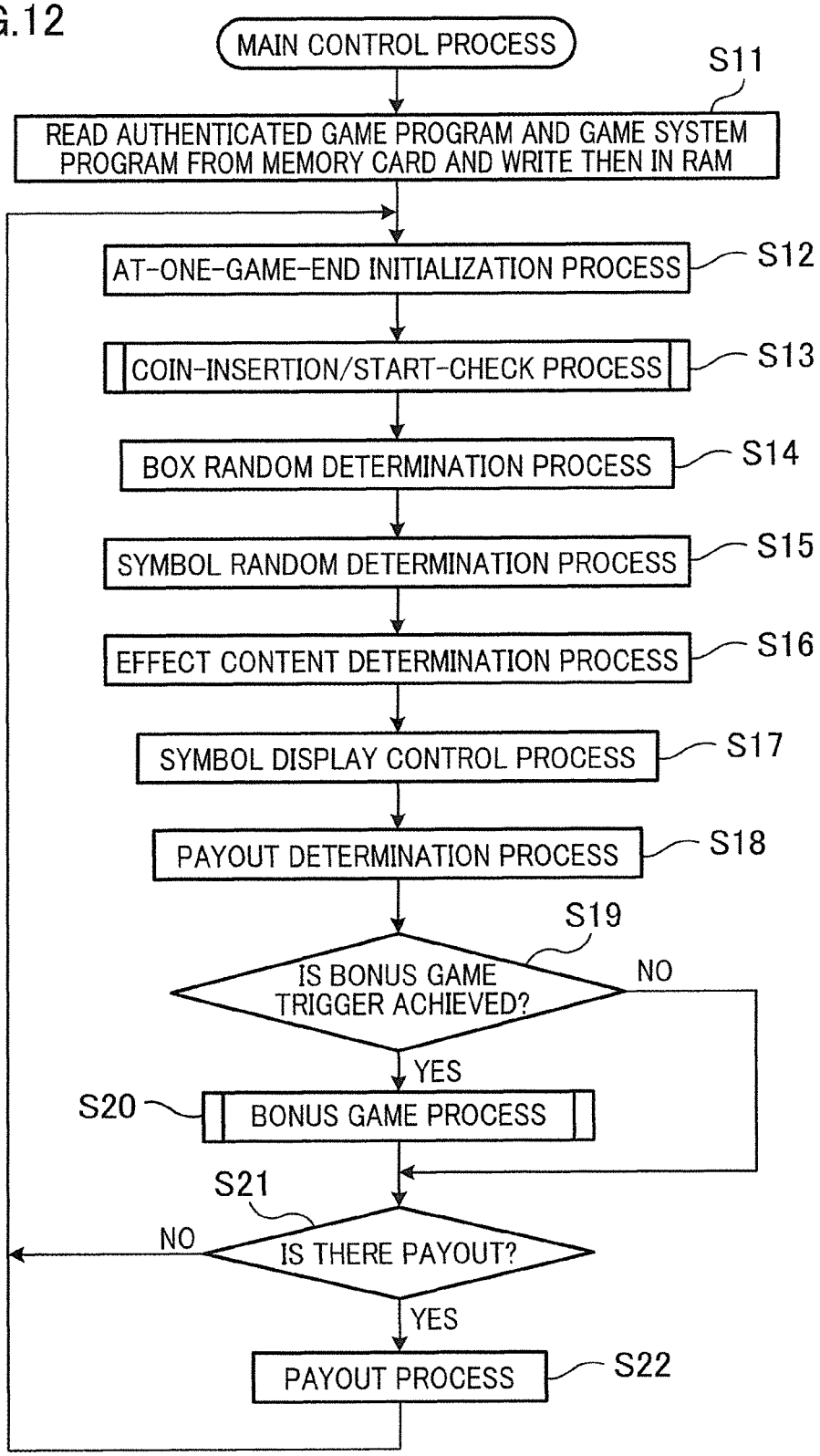
FIG. 12 is a flowchart of a main control process of the slot machine of First Embodiment.

First, with reference to FIG. 12, a main control process is described.

First, when the slot machine 10 is powered on, the main CPU 71 reads the authenticated game program and game system program from the memory card 54 through the gaming board 50, and writes the programs into the RAM 73 (S11).

Next, the main CPU 71 executes at-one-game-end initialization process (S12). For example, data that becomes unnecessary after each game in the working areas of the RAM 73, such as the bet amount and the symbols randomly determined, is cleared.

The main CPU 71 executes a coin-insertion/start-check process which is described later with reference to FIG. 13 (S13). In this process, an input check or the like is executed for the 1-bet switch 34S, the 2-bet switch 35S, the 3-bet switch 37S, the 4-bet switch 38S, the 5-bet switch 39S, the max-bet switch 45S, the play-2-lines switch 40S, the play-10-lines switch 41S, the play-20-lines switch 42S, the play-30-lines switch 43S, the spin switch 46S, or the like.

Figure 18:
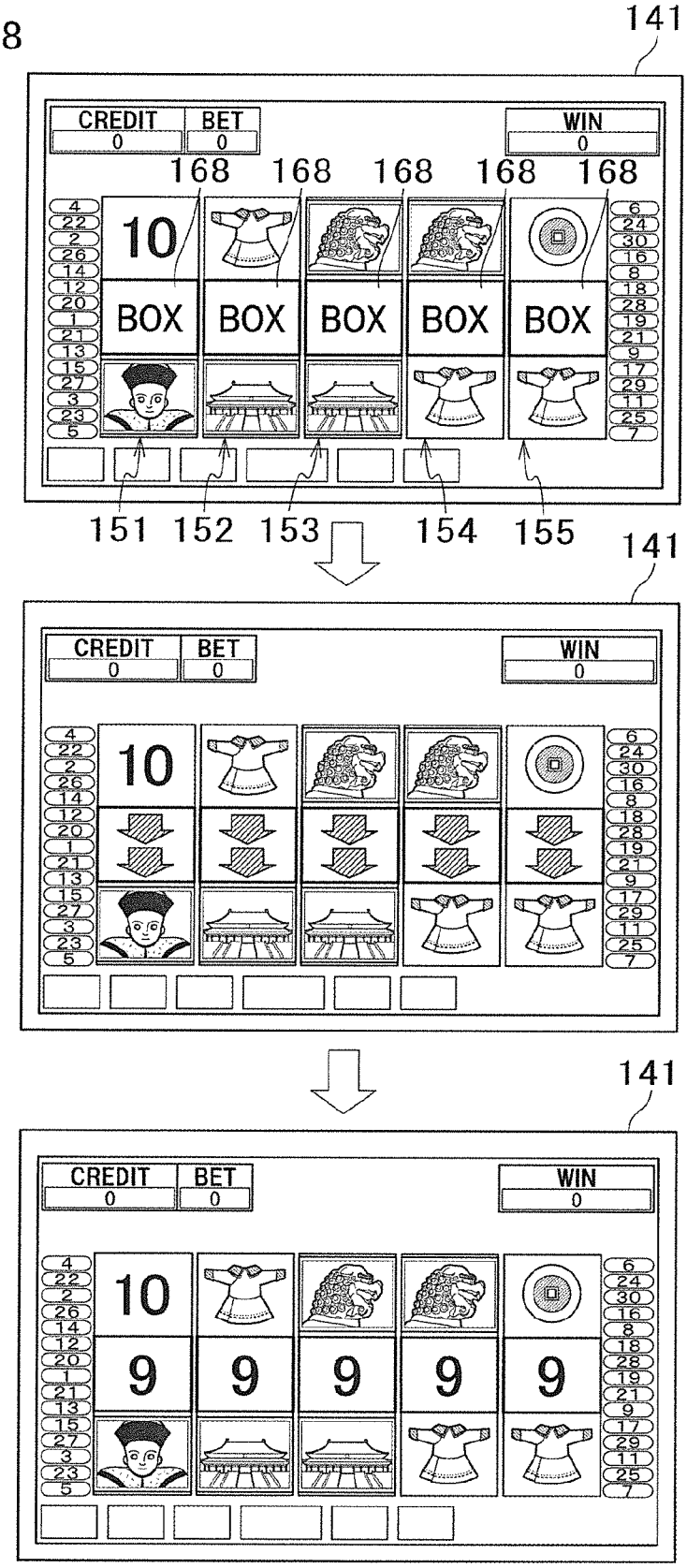
FIG. 18 shows an example of an image displayed on a lower image display panel in a main control process.

The main CPU 71 then executes box random determination process (S14). In this box random determination process, symbols displayed on box symbols 168 which are provided in each of the first video reel 151, the second video reel 152, the third video reel 153, the fourth video reel 154, and the fifth video reel 155 are randomly determined (see FIG. 18). In this regard, each of the randomly-determined symbols displayed on all box symbols 168 is one of "J", "Q", "9", "A", "10", "CURRENCY 161", "DRESS 162", "DRAGON 163", "CASTLE 164", "EMPEROR 165", "WILD 166", and "BONUS 167". More specifically, as shown in FIG. 18, when the box symbols 168 are displayed, the symbols "Q", "9", "A", "10", "CURRENCY 161", "DRESS 162", "DRAGON 163", "CASTLE 164", "EMPEROR 165", "WILD 166", and "BONUS 167" scroll downward in each of these box symbols 168. Then the scroll stops and a symbol is displayed on each of the box symbol 168 ("9" is displayed in the example of FIG. 18). While in the present embodiment only one type of symbol is displayed on all box symbols 168 after the random determination, differently symbols may be displayed in the respective box symbols 168 after the random determination.

Figure 24:
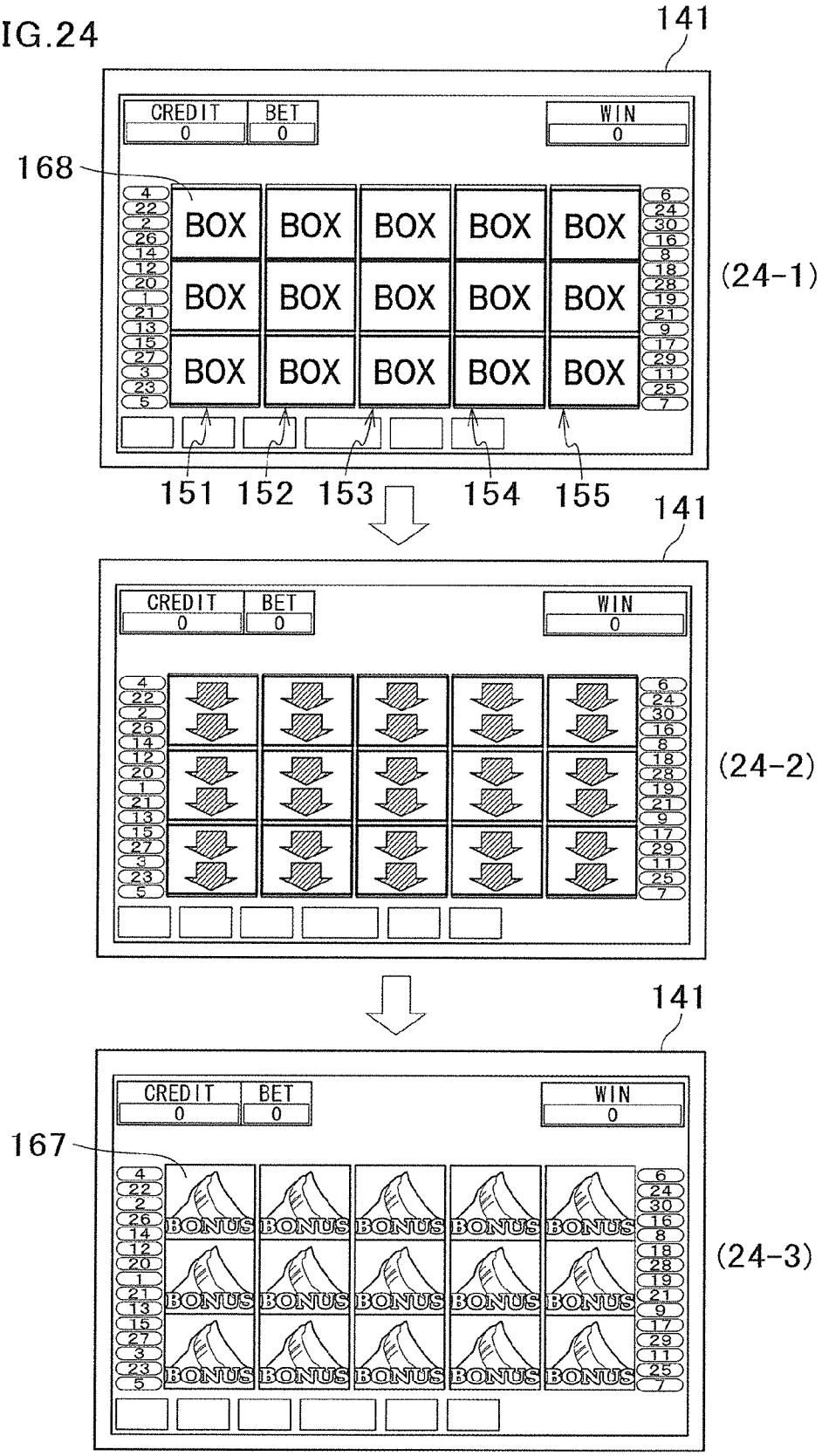
FIG. 24 shows an example of an image displayed on the lower image display panel in a main control process.

According to another specific example, in the box random determination process, after the box symbols 168 are displayed on all display blocks 28 of the video reels 151 to 155 as shown in (24-1) in FIG. 24, symbols "J", "Q", "9", "A", "10", "CURRENCY 161", "DRESS 162", "DRAGON 163", "CASTLE 164", "EMPEROR 165", "WILD 166", and "BONUS 167" scroll downward in each box symbol 168 as shown in FIG. 24. Then the scroll stops and a symbol is displayed on each box symbol 168 as shown in (24-3) in FIG. 24 ("BONUS 167" is displayed in the example of FIG. 24).

The main CPU 71 then executes a symbol random determination process (S15). In the process, to-be stopped symbol is determined based on the random numbers for symbol determination.

Specifically, the main CPU 71 first samples random numbers for symbol determination. The main CPU 71 then randomly determines to-be stopped symbol for the video reels 151-155. The main CPU 71 executes random determination for each of the video reels 151-155, and determines any one of the 22 symbols as the to-be stopped symbol.

The main CPU 71 then executes an effect contents determination process (S16). The main CPU 71 samples a random value for effect, and randomly selects any of the effect contents from the preset plurality of effect contents.

Figure 19:
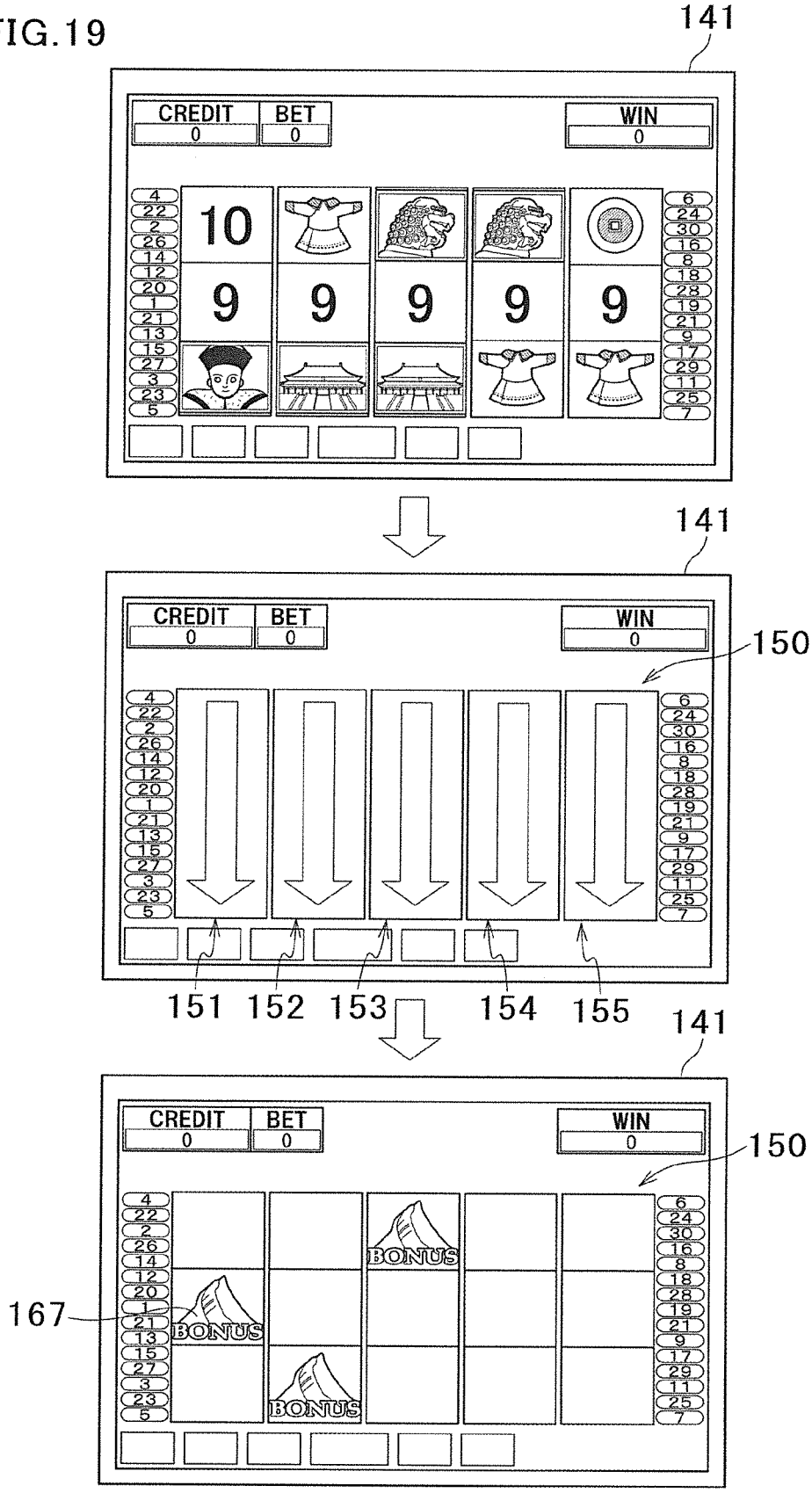
FIG. 19 shows an example of an image displayed on the lower image display panel in the main control process.
Figure 25:
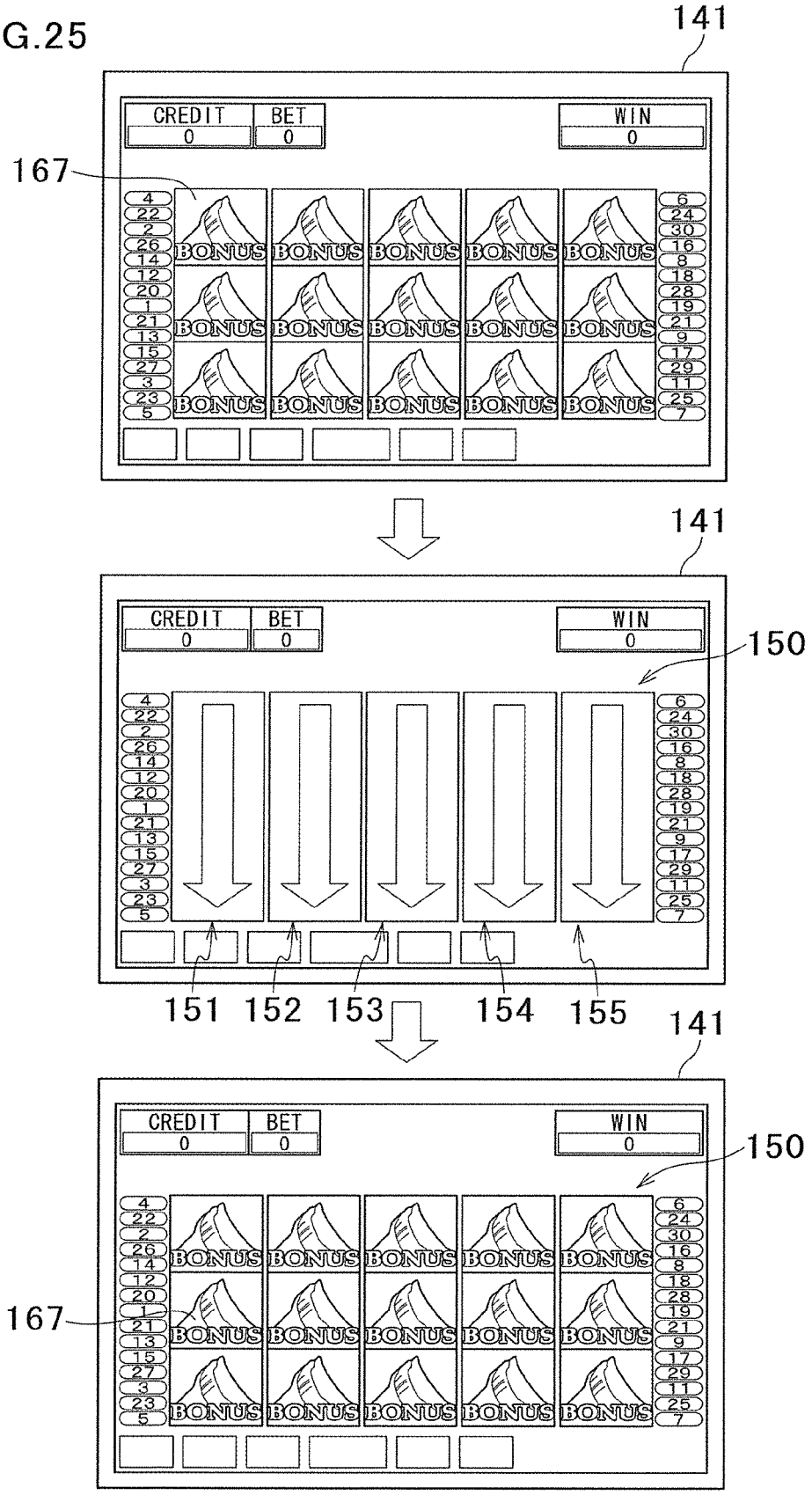
FIG. 25 shows an example of an image displayed on the lower image display panel in the main control process.

Next, the main CPU 71 executes the symbol display control process (S17). In the process, the scroll of the symbol column of each video reel 151-155 is started, and the to-be stopped symbol determined in the symbol random determination process of S14 is stopped at a predetermined position (e.g. the upper area in the display window 150), as shown in FIG. 19 or 25. That is, fifteen symbols including the to-be stopped symbol are displayed in the display window 150. FIG. 19 shows a case where three BONUS symbols 167 are displayed in the display window 150. FIG. 25 shows a case where 15 BONUS symbols 167 are displayed on the display window 150.

The main CPU 71 then executes the payout determination process (S18). In this process, the payout determination table 191 in the RAM 73 is referred to, and the payout amount is determined based on a combination of the symbols displayed on an active payline 300, and the payout amount thus determined is stored in the payout amount storage area in the RAM 73.

Next, the main CPU 71 determines whether or not bonus game trigger is met (S19). As shown in FIG. 19 or 25, a trigger of the shifting to the bonus game in the present embodiment is rearrangement of at least one symbol BONUS 167 in the display block 28 of each of the first video reel 151, the second video reel 152, and the third video reel 153. Therefore, even if three BONUS symbols 167 are rearranged on the first video reel 151 and three BONUS symbols 167 are rearranged on the second video reel 152, the bonus game trigger is not established unless a BONUS symbol 167 is rearranged on the third video reel 153. When the bonus game trigger is established (S19: YES), the main CPU71 executes a later-described bonus game process (S20).

Thereafter, after the step S20 or when it is determined in the step S19 that the bonus game trigger is not established (S19: NO), the main CPU 71 determines whether there is a payout (S21). That is to say, whether a payout has been awarded in S18 or S21 is determined. When there is a payout (S21: YES), a payout process is executed (step S22). The main CPU 71 adds the value stored in the payout amount storage area to the value stored in the credit amount storage area provided in the RAM 73. Alternatively, the hopper 113 may be driven based on an input to the collect switch 32S, and coins are discharged to the coin tray 18 according to the value stored in the payout amount storage area. After this process or when it is determined in S21 that there is no payout (S21: NO), the process proceeds to the step S12.

(Coin-Insertion/Start-Check Process)

Figure 13:
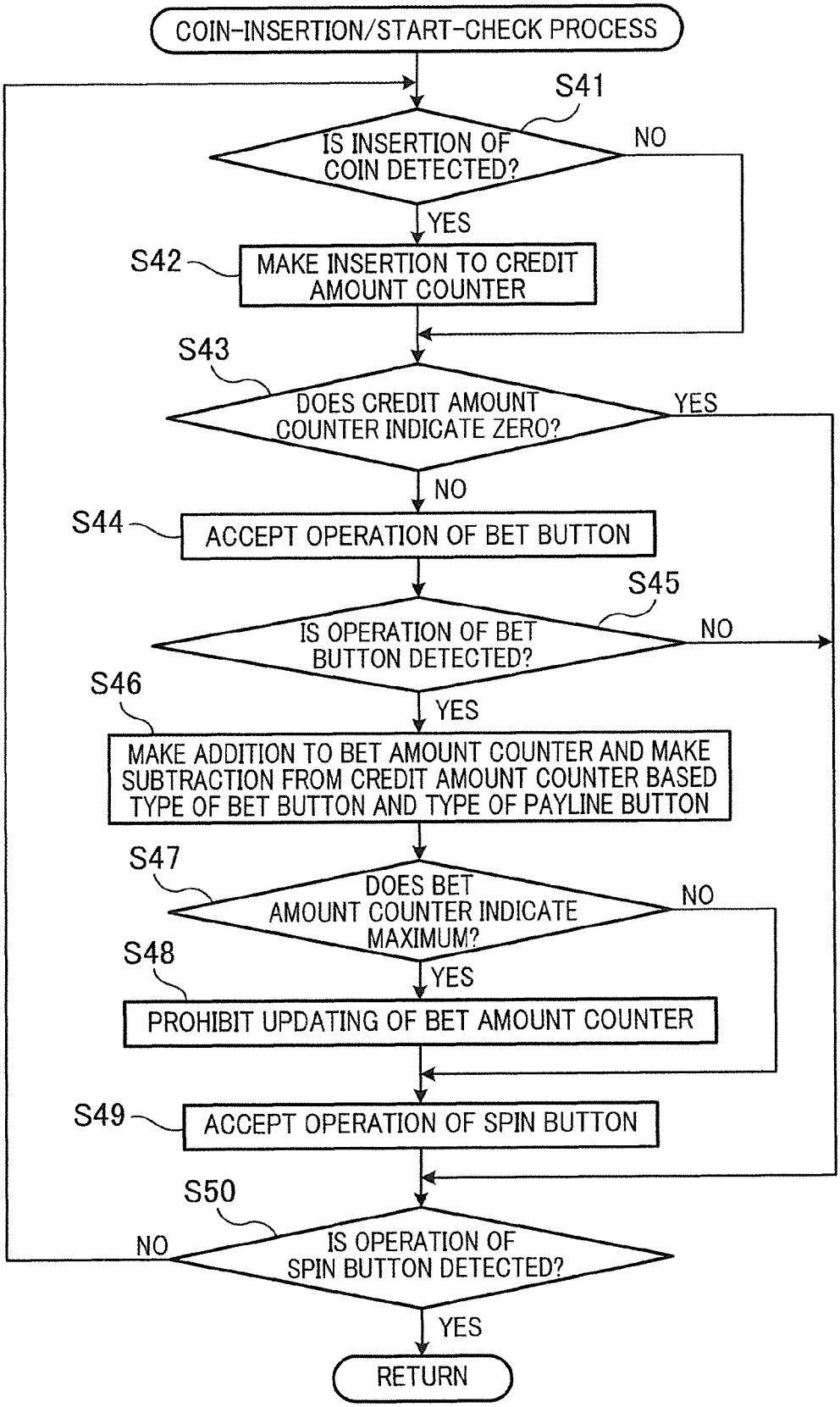
FIG. 13 is a flowchart of a coin-insertion/start-check process of the slot machine of First Embodiment.

Next, with reference to FIG. 13, the coin-insertion/start-check process is described.

First, the main CPU 71 determines whether or not insertion of a coin has been detected by the coin counter 92C (S41). When determining that the insertion of a coin has been detected by the coin counter 92C, the main CPU 71 makes addition to the value stored in the credit amount storage area (S42). It is to be noted that the main CPU 71 may determine whether or not insertion of a bill has been detected by the bill entry 115, and when determining that the insertion of a bill has been detected, the main CPU 71 may add a value according to the bill to the value stored in the credit amount storage area.

After S42 or when determining in S41 that the insertion of a coin has not been detected, the main CPU 71 determines whether or not the value stored in the credit amount storage area is zero (S43). When the main CPU 71 determines that the value stored in the credit amount storage area is not zero, the main CPU 71 permits operation acceptance of the bet buttons (1-bet button 34, 2-bet button 35, 3-bet button 37, 4-bet button 38, 5-bet button 39, and max-bet button 45) (S44). Note that, in S44, an operation of the payline button (play-2-lines button 40, play-10-lines button 41, play-20-lines button 42, and play-30-lines button 43) is enabled. Operation of the payline button enables activation of a desirable number of paylines 300.

Next, the main CPU 71 determines whether or not operation of any of the BET buttons has been detected (S45). When the main CPU 71 determines that the bet switch (1-bet switch 34S, 2-bet switch 35S, 3-bet switch 37S, 4-bet switch 38S, 5-bet switch 39S, and max-bet switch 45S) has detected the pressing of the BET button by the player, the main CPU 71 makes addition to a value stored in a bet amount storage area provided in the RAM 73 and makes subtraction from the value stored in the credit amount storage area, based on the type of the bet button and the type of the payline button (S46).

The main CPU 71 then determines whether or not the value stored in the bet amount storage area is at its maximum (S47). The main CPU 71, when determining that the value stored in the bet amount storage area is the maximum value, prohibits updating of the value stored in the bet amount storage area (S48). After S48 or when determining in S47 that the value stored in the bet amount storage area is not at its maximum, the main CPU 71 permits operation acceptance of the start button 46 (S49).

After S49, when determining in S45 that the operation of any of the BET buttons has not been detected, or when determining in S43 that the value stored in the credit amount storage area is zero, the main CPU 71 determines whether or not operation of the start button 46 has been detected (S50). The main CPU 71 shifts the process to S41, when determining that no operation of the start button 46 is detected.

When the main CPU 71 determines that the operation of the start button 46 has been detected, the coin-insertion/start-check process is ended.

(Bonus Game Process)

Figure 14:
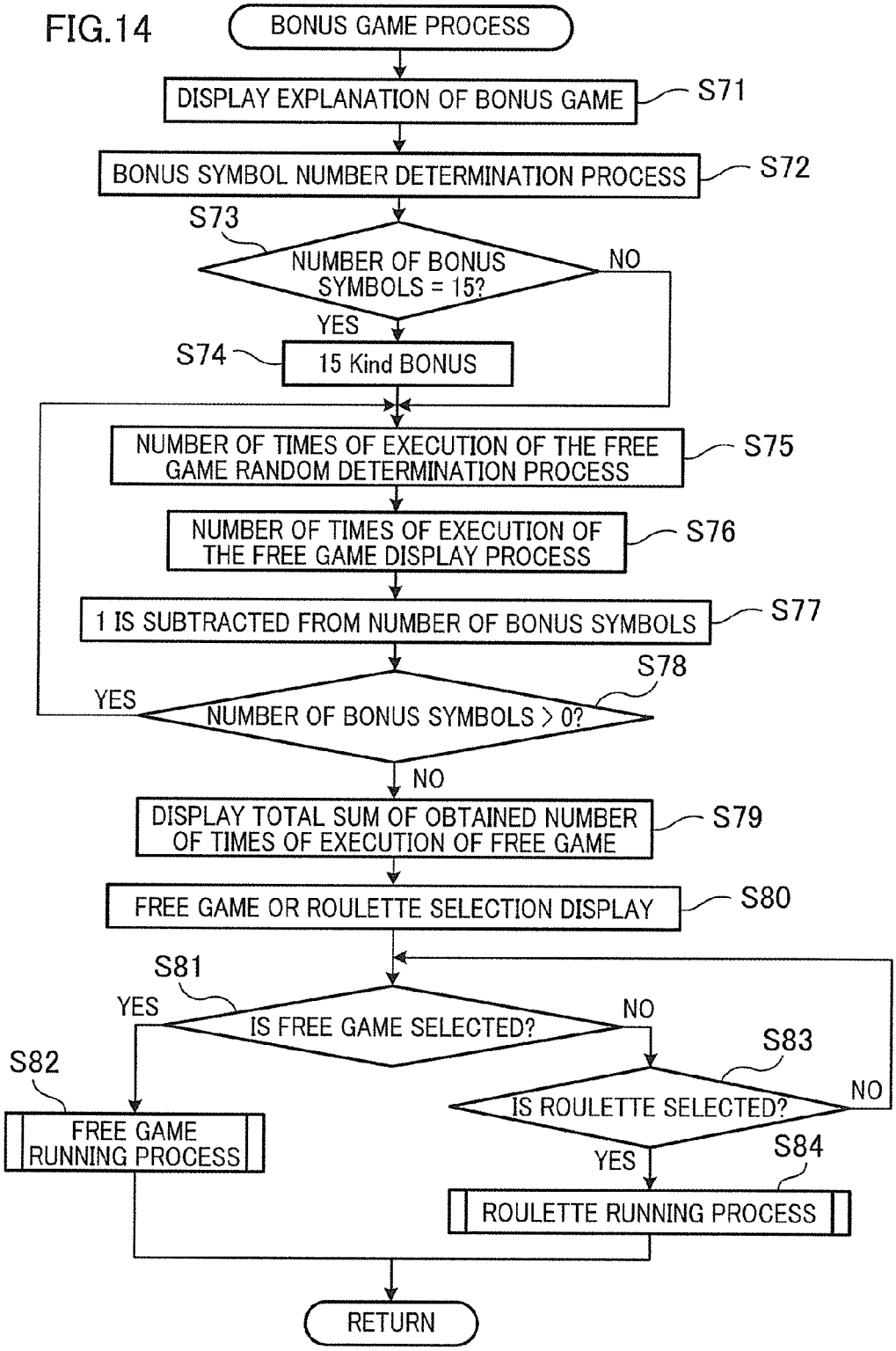
FIG. 14 is a flowchart of a bonus game process of the slot machine of First Embodiment.

Now, referring to FIG. 14, the bonus game process will be described. The bonus game process is, as shown in FIG. 12, executed on condition that the bonus game trigger is established in the main control process (see the step S20).

Figure 20:
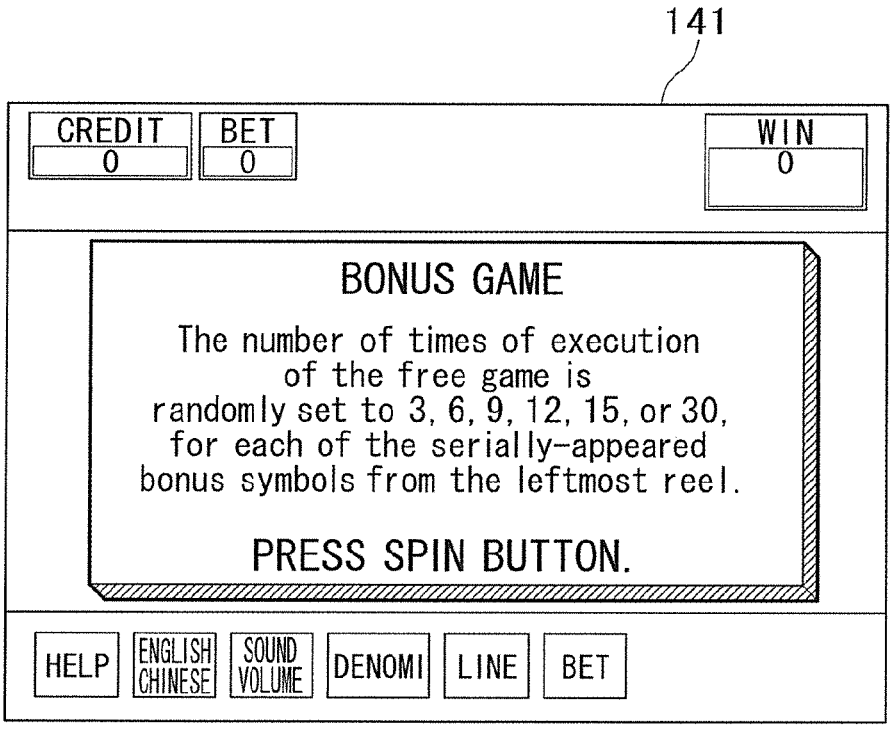
FIG. 20 shows an example of an image displayed on the lower image display panel in a bonus game process.

To begin with, as shown in FIG. 20, the main CPU 71 displays, on the lower image display panel 141, a screen describing the content of the bonus game (S71: bonus game description display). In the bonus game description display, the player is prompted to press the spin button 46.

Subsequently, the main CPU 71 executes a bonus symbol number determination process when the spin button is pressed (S72). In this bonus symbol number determination process, how many symbols BONUS 167 are displayed in the display window 150 when the bonus game trigger is established is determined. In this determination, which one of the numbers, three to fifteen, the number of the symbol BONUS 167 is, is determined. For example, in case of FIG. 19, it is determined that three BONUS symbols 167 are rearranged on the display window 150. In case of FIG. 25, it is determined that 15 BONUS symbols 167 are rearranged on the display window 150. The number of the BONUS symbols 167 determined in the bonus symbol number determination process is stored in the RAM 73.

Figure 26:
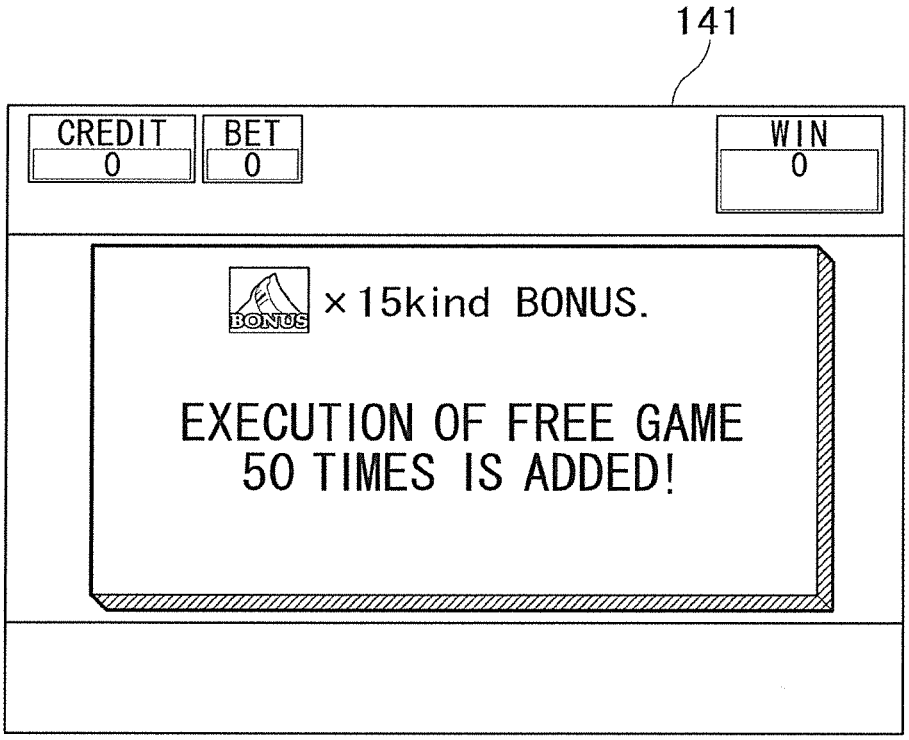
FIG. 26 shows an example of an image displayed on the lower image display panel in the bonus game process.

Subsequently, whether the number of the BONUS symbols 167 determined in the bonus symbol number determination process in S72 is 15 is determined (S73). When, for example, the number of the BONUS symbols 167 is 15 as in the case of FIG. 25 (S73: YES), a 15-Kind bonus is awarded (S74). With this 15-Kind bonus, the execution of the free game 50 times is awarded. Thereafter, as shown in FIG. 26, on the lower image display panel 141, information indicating that the right to execute the free game 50 times is awarded as the 15-Kind bonus is displayed. In the present embodiment, the right to execute the free game 50 times is awarded as the 15-Kind bonus when the number of the BONUS symbols 167 determined in the bonus symbol number determination process in S72 is 15. In this regard, the number of times of execution of the free game to be awarded and the number of the BONUS symbols 167 determined in the bonus symbol number determination process in S72 as a condition for awarding the 15-Kind bonus may be optionally set.

After S74 or when the number of the BONUS symbols 167 determined in S73 is not 15 (S73: NO), the main CPU 71 executes a number of times of execution of free game random determination process to determine the number of times of execution of the free game to be awarded (S75). In the number of times of execution of free game random determination process, the number of times of execution of the free game is randomly determined based on the symbols BONUS 167 rearranged in the display window 150, serially in the order of "1" to "15" displayed in the display block 28 of the display window 150 shown in FIG. 21.

Figure 21:
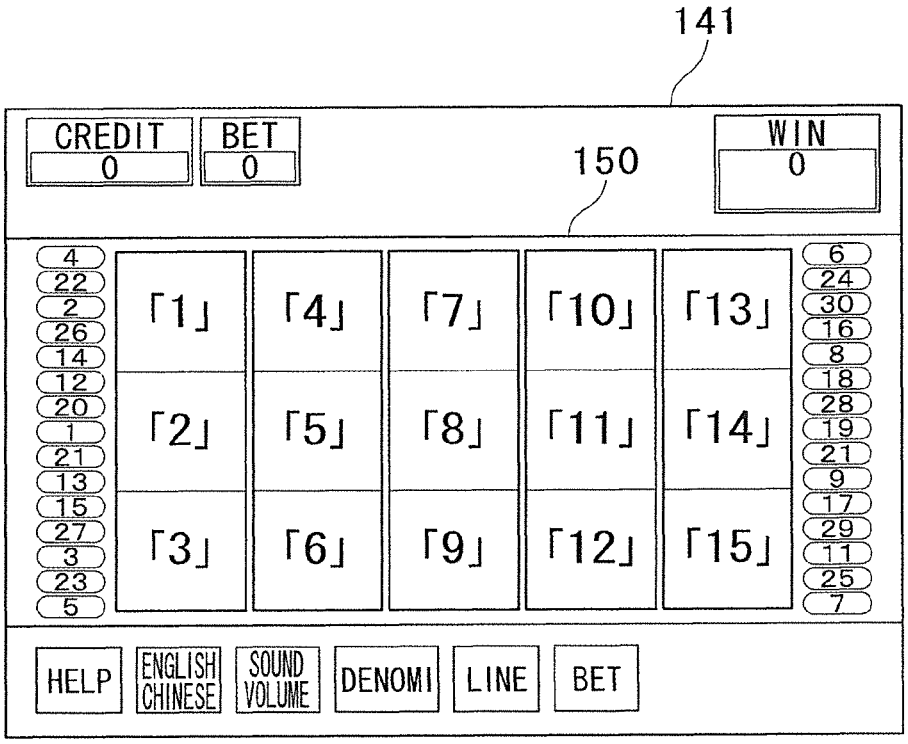
FIG. 21 is an explanatory diagram of the bonus game process.

More specifically, because in the present embodiment the symbols BONUS 167 are rearranged in the positions "2", "6", and "7" as shown in FIG. 19 and FIG. 21, the random determination of the number of times of execution of the free game is performed first for the symbol BONUS 167 at "2". In this random determination of the number of times of execution of the free game, a random determination table in the bonus game number random determination table 192, which corresponds to the number of the bonus symbols 167 determined in S72, is referred to. For example, as shown in FIG. 19, because in the present embodiment the number of the bonus symbols 167 is determined as three in S72, a "Very_Low" random determination table in the bonus game number random determination table 192 shown in FIG. 10 is referred to. As shown in FIG. 10, when in S72 the number of the bonus symbols 167 is determined as 3 to 5, the "Very_Low" random determination table in the bonus game number random determination table 192 is referred to. When the number of the bonus symbols 167 is determined as 6 to 8, a "Low" random determination table in the bonus game number random determination table 192 is referred to. When the number of the bonus symbols 167 is determined as 9 to 10, a "Middle" random determination table in the bonus game number random determination table 192 is referred to. When the number of the bonus symbols 167 is determined as 11 to 12, a "High" random determination table in the bonus game number random determination table 192 is referred to. When the number of the bonus symbols 167 is determined as 13 to 14, a "Very_High" random determination table in the bonus game number random determination table 192 is referred to. When the number of the bonus symbols 167 is determined as 15, an "EXTRA" random determination table in the bonus game number random determination table 192 is referred to.

Subsequently, the main CPU 71 executes a number of times of execution of free game display process (S76). In the number of times of execution of free game display process, the number of times of execution of the free game randomly determined in S75 is displayed on the front surface of the bonus symbol 167 as shown in (22-1) in FIG. 22 ("3" is displayed in the present embodiment). In addition to the above, in an awarded number of times of execution of the free game display window 170, the total sum of the numbers of times of execution of the free game awarded in the bonus game process is displayed. In the present embodiment, the number "3" is displayed on the display window 170 shown in (22-1) in FIG. 22.

Subsequently, the main CPU 71 updates the number of symbols BONUS 167 stored in the RAM 73 by subtracting one therefrom (S77). In the present embodiment, the number of the symbols BONUS 167 stored in the RAM 73 is updated to 2 such that 1 is subtracted from 3 which is the number having been stored as the number of symbols.

Subsequently, the main CPU 71 determines whether the number of the symbols BONUS 167 updated in S77 is larger than 0 (S78). Because in the present embodiment the number of the symbols BONUS 167 updated in S77 is 2, the result of the determination is larger than 0, and the process proceeds to S75.

In S75, the main CPU 71 again executes the number of times of execution of free game random determination process for determining the number of times of execution of the free game to be awarded (S75). In this number of times of execution of free game random determination process, in case of FIG. 19 and FIG. 21, the number of times of execution of the free game is randomly determined for the symbol BONUS 167 at "6".

Thereafter, the main CPU 71 executes the number of times of execution of free game display process as described above (S76). In the number of times of execution of free game display process, the number of times of execution of the free game awarded as a result of the random determination in S75 is displayed on the front surface of the bonus symbol 167 as shown in (22-2) in FIG. 22 ("6" is displayed in the present embodiment). In the awarded number of times of execution of the free game display window 170, the total sum of the numbers of times of execution of the free game awarded in the bonus game process is displayed. In the present embodiment, "9 (3+6)" is displayed in the display window 170 shown in (22-2) in FIG. 22.

Subsequently, the main CPU 71 updates the number of the symbols BONUS 167 stored in the RAM 73 by subtracting 1 therefrom (S77). In the present embodiment, the value "1" calculated by subtracting 1 from the number "2" of the symbols BONUS 167 stored in the RAM 73, and this value is used as an updated value of the number of the symbols BONUS 167.

Subsequently, the main CPU 71 again determines whether the number of the symbols BONUS 167 is larger than 0 (S78). In the present embodiment, because the number of the symbols BONUS 167 updated in S77 is 1, the number is larger than 0 and the process proceeds to S75.

After the shifting to S75, the main CPU 71 again executes the number of times of execution of free game random determination process for determining the number of times of execution of the free game to be awarded (S75). In this number of times of execution of free game random determination process, in cases of FIG. 19 and FIG. 21, the number of times of execution of the free game is randomly determined for the symbol BONUS 167 at "7".

Then the main CPU 71 executes, as described above, the number of times of execution of free game display process (S76). In the number of times of execution of free game display process, the number of times of execution of the free game awarded as a result of the random determination in S75 is displayed on the front surface of the bonus symbol 167 as shown in (22-3) in FIG. 22 ("3" is displayed in the present embodiment). Furthermore, in the awarded number of times of execution of the free game display window 170, the total sum of the numbers of times of execution of the free game awarded in the bonus game process is displayed. In the present embodiment, "12 (3+6+3)" is displayed in the display window 170 shown in (22-3) in FIG. 22.

Subsequently, the main CPU 71 updates the number of the symbols BONUS 167 stored in the RAM 73 by subtracting 1 therefrom (S77). In the present embodiment, a value "0" calculated by subtracting 1 from 1 which is the number of the symbols BONUS 167 stored in the RAM 73 is set as the updated number of the symbols BONUS 167.

Subsequently, the main CPU 71 again determines whether the number of the symbols BONUS 167 updated in S77 is larger than 0 (S78). In the present embodiment, the number of the symbols BONUS 167 updated in S75 is 0 and therefore the number is determined as not larger than 0 (S78: NO).

Figure 23:
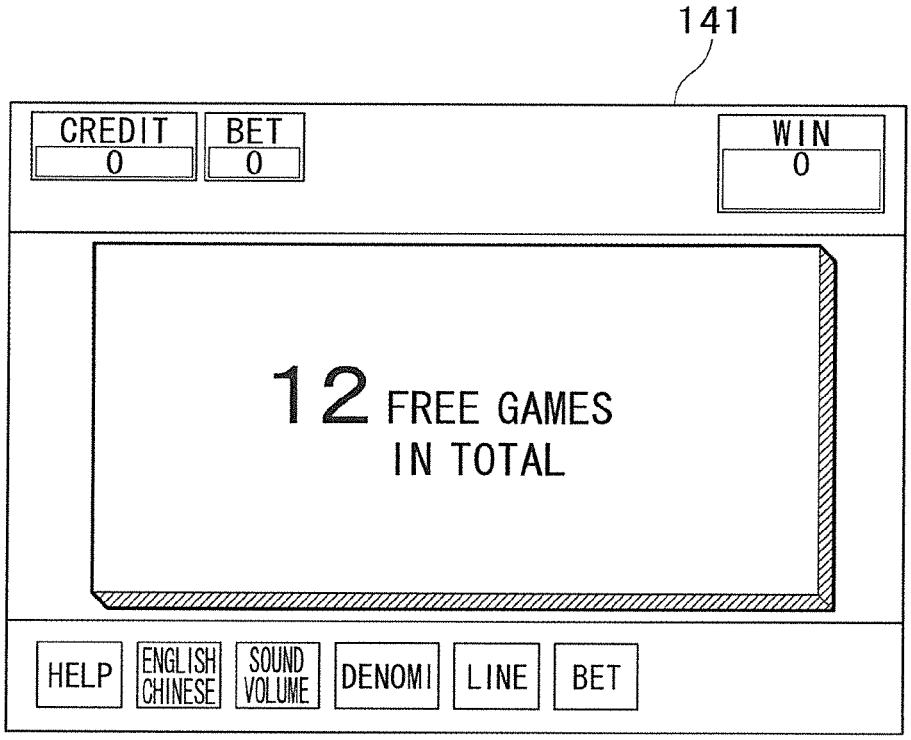
FIG. 23 shows an example of an image displayed on the lower image display panel in the bonus game process.

When the number of the symbols BONUS 167 updated in S77 is not larger than 0 (S78: NO), as shown in FIG. 23, the total sum of the numbers of times of execution of the free game awarded in the bonus game process is displayed on the front surface of the lower image display panel 141 (S79). In the present embodiment, on the front surface of the lower image display panel 141 a value "12" which is the total sum of the numbers of times of execution of the free game awarded in the bonus game process is displayed. When the execution of the free game 50 times is awarded as the 15-Kind bonus in S74, the total number of times of execution of the free game, to which the execution of the free game 50 times has been added, is displayed on the front surface of the lower image display panel 141.

Figure 27:
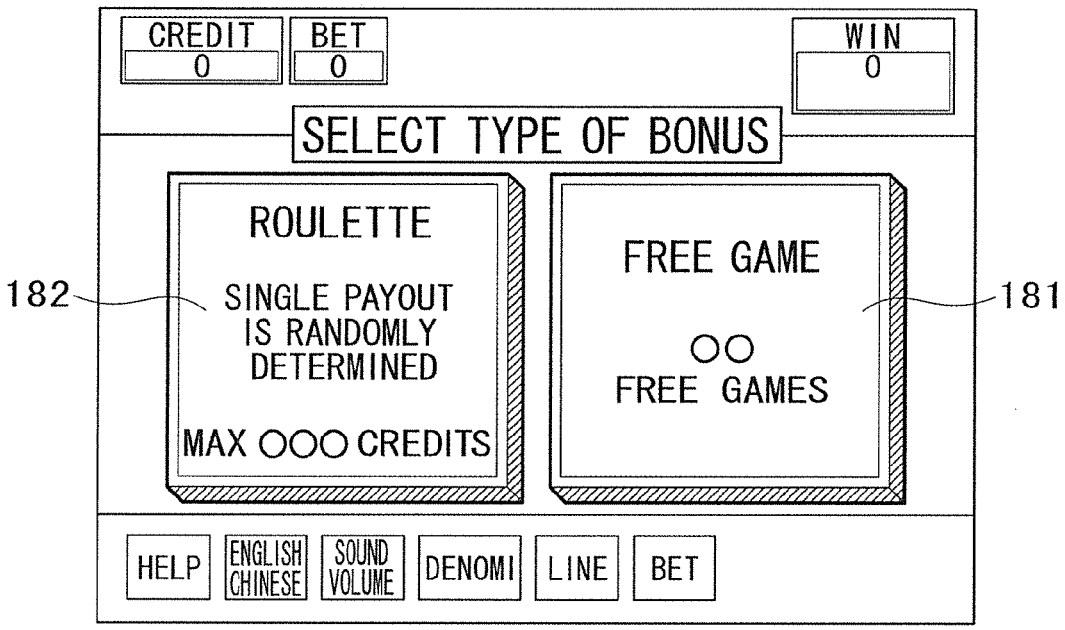
FIG. 27 shows an image displayed on the lower image display panel in the bonus game process.

Subsequently, as shown in FIG. 27, on the lower image display panel 141, a free game selection button 181 for executing the free game for the awarded number of times and a roulette selection button 182 for running a roulette game in which a payout is awarded after the execution of random determination once are displayed (S80). On the lower image display panel 141, a message encouraging the player to select one of the free game selection button 181 and the roulette selection button 182 is displayed.

Alternatively, on the lower image display panel 141, an estimated termination time which indicates when the running of the free game for the awarded number of times ends may be displayed when the free game selection button 181 and the roulette selection button 182 are displayed. For example, a value calculated by multiplying a (predetermined) time required to run the free game once by the awarded number of times of execution of the free game is converted to time and displayed.

Subsequently, the main CPU 71 determines whether the free game selection button 181 is selected (S81). When the free game selection button 181 is selected (S81: YES), a later-described free game running process is executed (S82).

In the meanwhile, when the free game selection button 181 is not selected (S81: NO), whether the roulette selection button 182 is selected is determined (S83).

When the roulette selection button 182 is not selected (S83: NO), the process goes back to S81.

When the roulette selection button 182 is selected (S83: YES), a later-described roulette running process is executed (S84).

After S82 or S84, the process is terminated.

When the awarded number of times of execution of the free game is equal to or larger than a predetermined number (e.g., 100 or more), the free game selection button 181 for executing the free game for the awarded number of times and the roulette selection button 182 for running a roulette game in which a payout is awarded after the execution of random determination once may be displayed on the lower image display panel 141.

(Free Game Running Process)

Figure 15:
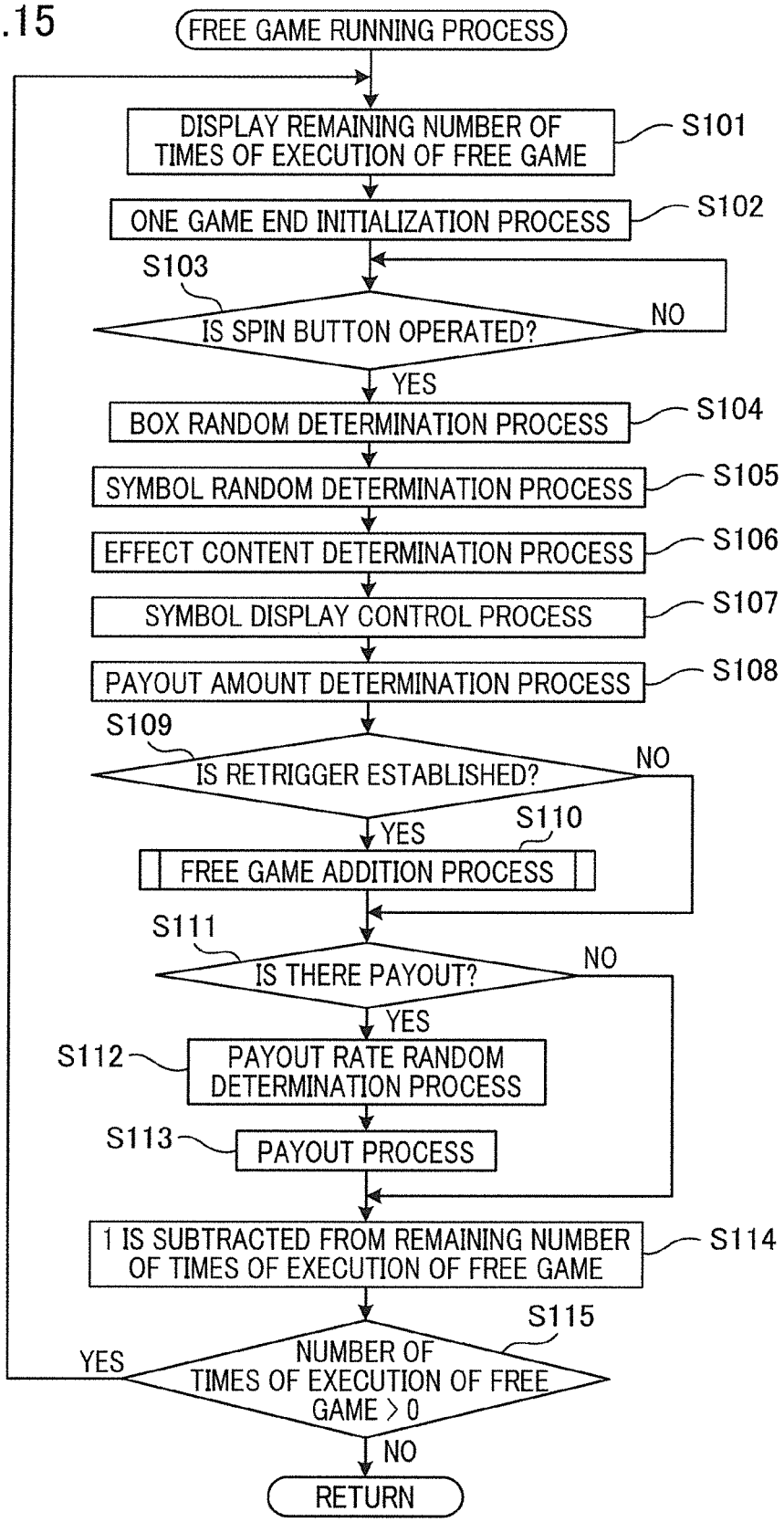
FIG. 15 is a flowchart of a free game running process of the slot machine of First Embodiment.

Now, the free game running process will be described with reference to FIG. 15. As shown in FIG. 14, the free game running process is executed when the free game selection button 181 is selected in the bonus game process (see the step S82). In the free game (equivalent to the bonus game) in the present embodiment, a slot game is run in the same manner as in the normal game.

Figure 28:
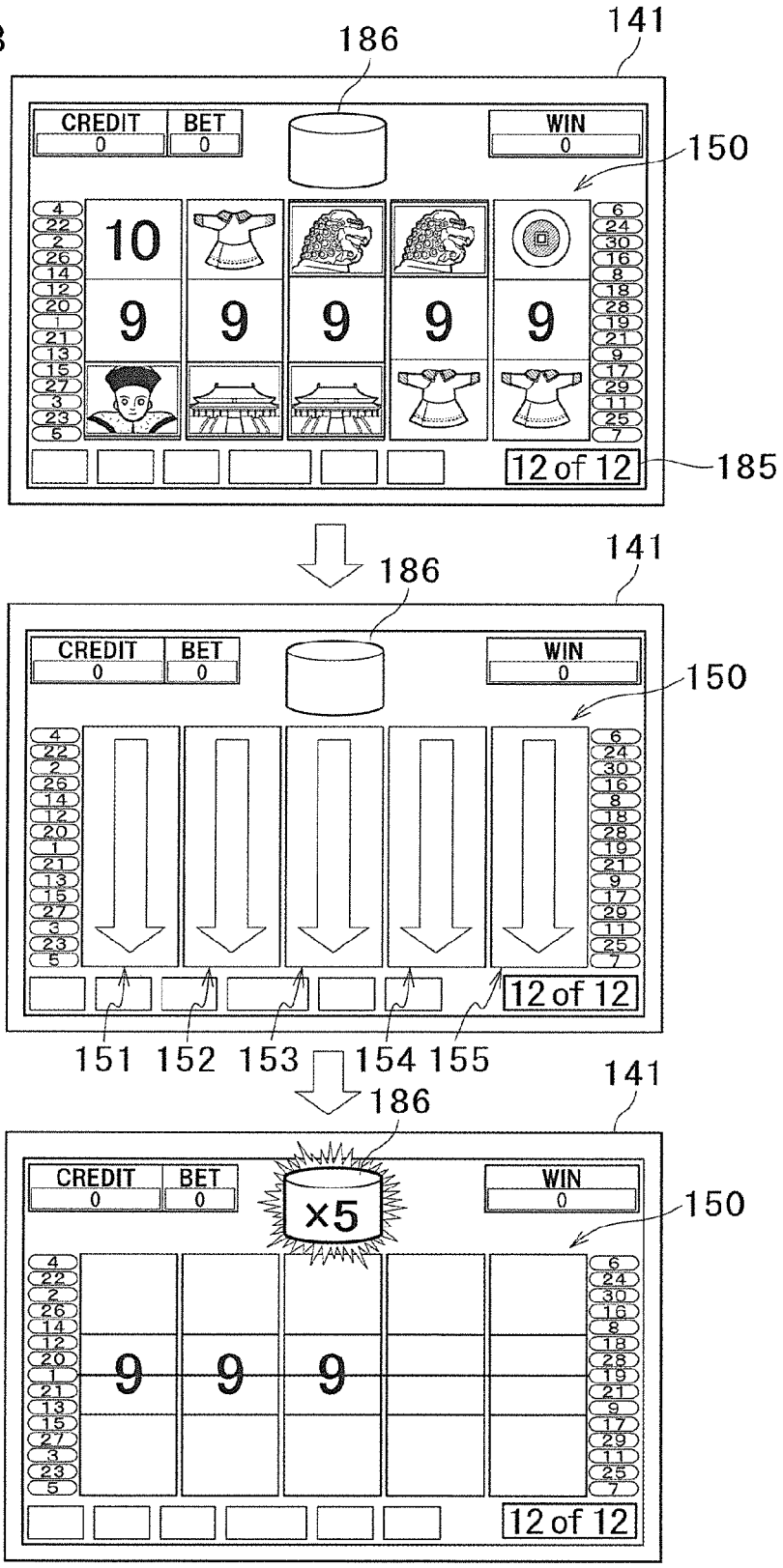
FIG. 28 shows an example of an image displayed on the lower image display panel in a free game running process.

To begin with, as shown in FIG. 28, the number of times of execution of the free game obtained in the bonus game process is displayed on a remaining number of times of execution of the free game display window 185 (S101). In the present embodiment, as shown in FIG. 23, "12 of 12" is displayed on the remaining number of times of execution of the free game display window 185 because the awarded number of times of execution of the free game is twelve as shown in FIG. 23. The remaining number of times of execution of the free game is stored in the RAM 73.

Subsequently, the main CPU 71 executes a one game end initialization process (step S102). For example, a set of data which becomes redundant in the working area of the RAM 73 such as randomly-selected symbols each time a game is executed is deleted.

Subsequently, the main CPU 71 determines whether the spin button 46 is pressed (S103). When the spin button 46 is not pressed (S103: NO), the process becomes on standby.

In the meanwhile, when the spin button 46 is pressed (S103: YES), the main CPU 71 executes a box random determination process (S104). This box random determination process is identical with the process executed in S14 of the main control process described above. The random determination table of the symbols displayed in the box symbol 168 may be different from the table which is referred to in the main control process.

Subsequently, the main CPU 71 executes a symbol random determination (S105). In this process, the to-be stopped symbol is determined based on a symbol determination random number.

More specifically, to begin with, the main CPU 71 samples a random number for determining symbols. Subsequently, the main CPU 71 randomly selects to-be stopped symbol for each of the video reels 151 to 155. The main CPU 71 performs random determination for each of the video reels 151 to 155, and one of 22 symbols is selected as the to-be stopped symbol.

Subsequently, the main CPU 71 executes an effect content determination process (step S106). The main CPU samples an effect-use random number and randomly selects one of predetermined effect contents.

Subsequently, the main CPU 71 executes a symbol display control process (step S107). In this process, as shown in FIG. 28, the symbol column of each of the video reels 151 to 155 starts to scroll, and the symbols of the to-be stopped symbol selected in the symbol random determination in step S105 stops at a predetermined position (e.g., at the upper row in the display window 150). In other words, 15 symbols including the to-be stopped symbol are displayed in the display window 150.

Subsequently, the main CPU 71 executes a payout amount determination process (step S108). In this process, the payout amount is determined based on the combination of the symbols displayed on the display window 150, and the determined amount is stored in a payout amount storage area in the RAM 73.

Figure 29:
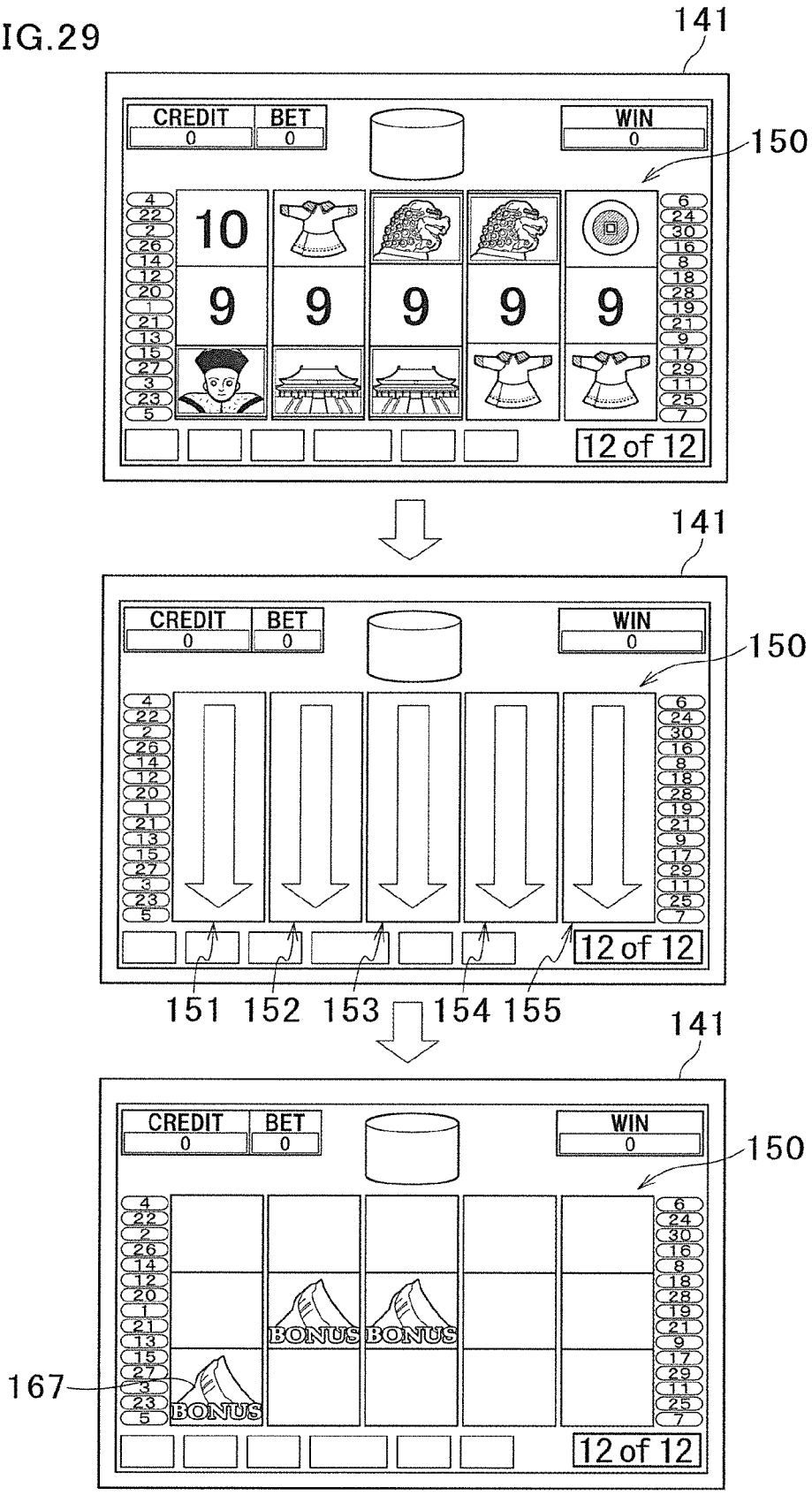
FIG. 29 shows an example of an image displayed on the lower image display panel in the free game running process.

Subsequently, the main CPU 71 determines whether re-trigger is established (step S109). As shown in FIG. 29, the re-trigger with which the number of times of execution of the free game is increased in the present embodiment indicates that at least one symbol BONUS 167 is rearranged in each of the display blocks 28 of the first video reel 151, the second video reel 152, and the third video reel 153. When the re-trigger is established (S109: YES), the main CPU 71 executes a later-described free game addition process (step S110).

Subsequently, after S110 or when it is determined in the step S109 that the re-trigger is not established (S109: NO), the main CPU 71 determines whether a payout is necessary (S111). In other words, whether a payout has been awarded in S108 is determined. When there is a payout (S111: YES), a payout rate random determination process is executed so that the payout rate of the payout is randomly determined (S112).

In this payout rate random determination process, the main CPU 71 randomly sets the payout rate of the payout to one of "×2", "×3", "×4", and "×5". As shown in FIG. 28, the selected payout rate is displayed on a payout rate display window 186 ("×5" is displayed in FIG. 28).

Then a payout process is executed (S113). In this payout process, a value calculated by multiplying the payout determined in S108 by the payout rate determined in S112 is awarded to the player as a final payout. For example, when the payout determined in S108 is 100 credits and the payout rate determined in S112 is "×5", 500 credits (100×5=500) are awarded to the player as the final payout.

Subsequently, after S113 or when there is on payout in S111 (S111: NO), the main CPU 71 updates the remaining number of times of execution of the free game stored in the RAM 73 by subtracting 1 therefrom (S114). For example, when the remaining number of times of execution of the free game stored in RAM 73 is "12", the remaining number of times of execution of the free game is updated to "11" as 1 is subtracted from 12.

Subsequently, the main CPU 71 determines whether the remaining number of times of execution of the free game updated in S114 is larger than 0 (S115). When the remaining number of times of execution of the free game is larger than 0 (S115: YES), the process proceeds to S101.

In the meanwhile, when the remaining number of times of execution of the free game is not larger than 0 (S115: NO), the process is terminated.

(Free Game Addition Process)

Figure 16:
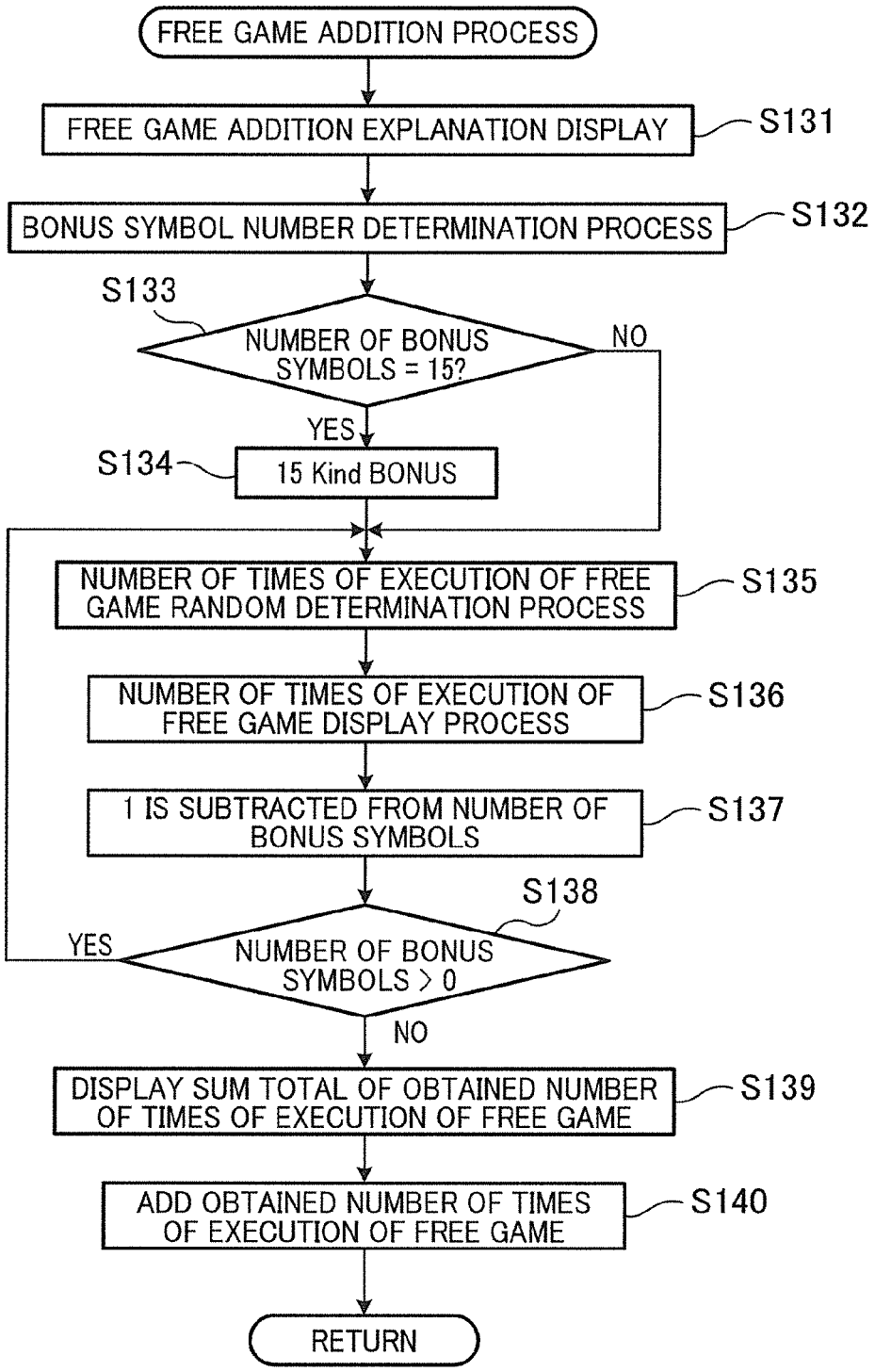
FIG. 16 is a flowchart of a free game addition process of the slot machine of First Embodiment.

Now, a free game addition process will be described with reference to FIG. 16. As shown in FIG. 15, the free game addition process is executed when the re-trigger is established in the free game running process (see the step S110).

To begin with, the main CPU 71 displays, on the lower image display panel 141, a screen explaining the addition to the free game (S131: free game addition explanation display). In the free game addition explanation display, the player is prompted to press the spin button 46.

Subsequently, when the spin button 46 is pressed, the main CPU 71 executes a bonus symbol number determination process (S132). In this bonus symbol number determination process, how many symbols BONUS 167 are rearranged on the display window 150 when the re-trigger is established is determined. In this connection, the number of the symbols BONUS 167 falls within the range of 3 to 15. For example, in FIG. 29, it is determined that three symbols BONUS 167 are rearranged in the display window 150. The number of the symbols BONUS 167 determined in the bonus symbol number determination process is stored in the RAM 73.

Subsequently, whether the number of the BONUS symbols 167 determined in the bonus symbol number determination process in S132 is 15 is determined (S133). When the number of the BONUS symbols 167 is 15 (S133: YES), the 15-Kind bonus is awarded (S134). As the 15-Kind bonus, the execution of the free game 50 times is awarded. Then information indicating that the right to execute the free game 50 times is awarded as the 15-Kind bonus is displayed on the lower image display panel 141.

After S134 or when it is determined in S133 that the number of the BONUS symbols 167 is not 15 (S133: NO), the main CPU 71 executes a number of times of execution of free game random determination process of determining the number of times of execution of the free game to be added (S135). In the number of times of execution of free game random determination process, the number of times of execution of the free game for the symbols BONUS 167 rearranged on the display window 150 is randomly determined serially in the order of "1" to "15" displayed in the display block 28 of the display window 150 shown in FIG. 21.

More specifically, in the present embodiment, as the symbols BONUS 167 are provided at "3", "5", and "8" in FIG. 29 and FIG. 21, the random determination of the number of times of execution of the free game is performed first for the symbol BONUS 167 at "3". In this random determination of the number of times of execution of the free game, a random determination table of the bonus game number random determination table 192 which corresponds to the number of the bonus symbols 167 determined in S132 is used. For example, in the present embodiment, as shown in FIG. 29, because the number of the bonus symbols 167 is determined as three in S132, a "Very_Low" random determination table in the bonus game number random determination table 192 shown in FIG. 10 is referred to.

Figure 30:
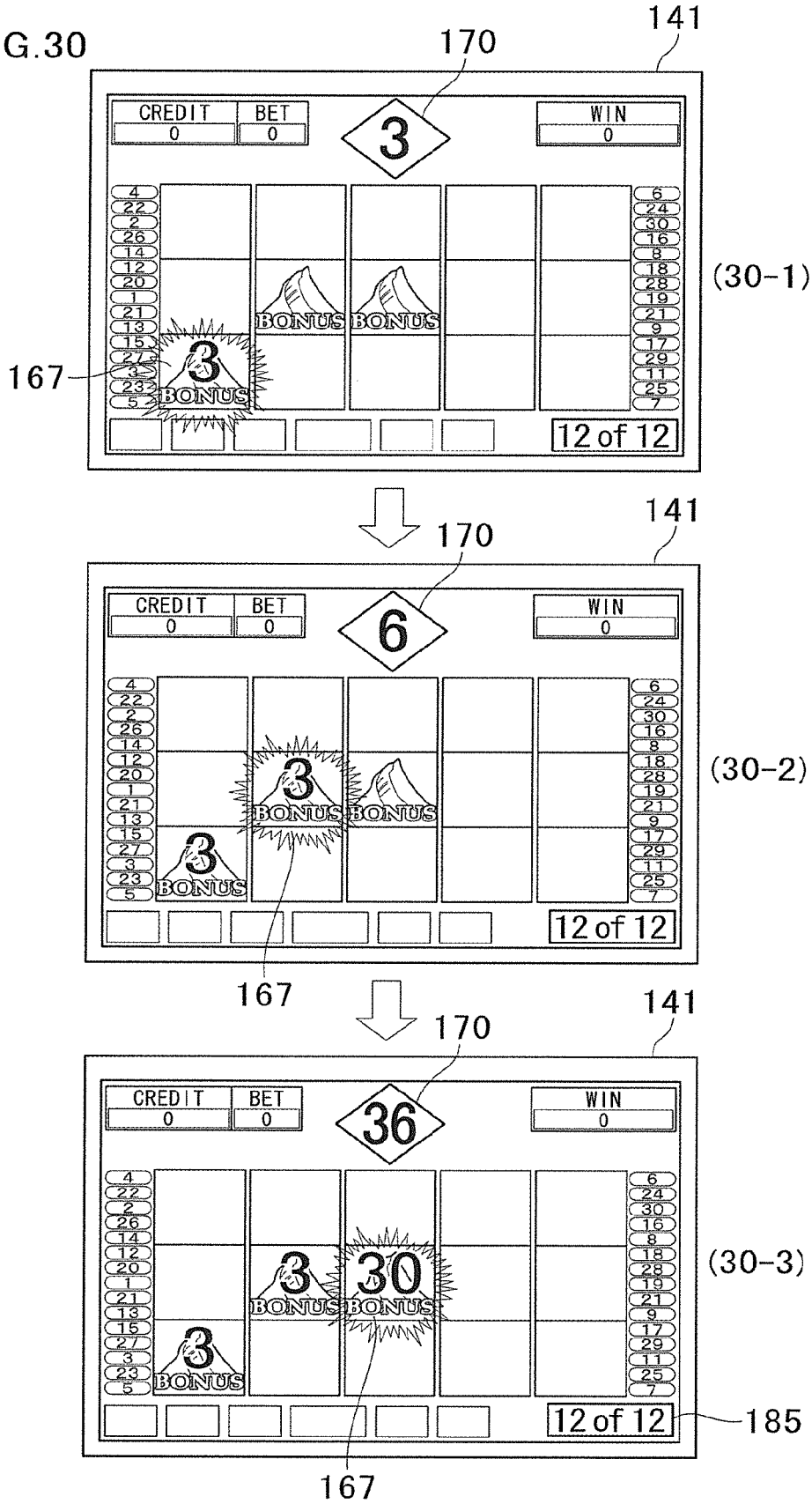
FIG. 30 shows an example of an image displayed on the lower image display panel in a free game addition process.

Subsequently, the main CPU 71 executes a number of times of execution of free game display process (S136). In the number of times of execution of free game display process, the number of times of execution of the free game awarded as a result of the random determination in S135 is displayed on the front surface of the bonus symbol 167 as shown in (30-1) in FIG. 30 ("3" is displayed in the present embodiment). In the awarded number of times of execution of the free game display window 170, the total sum of the numbers of times of execution of the free game awarded in the free game addition process is displayed. In the present embodiment, "3" is displayed in the display window 170 shown in (30-1) of FIG. 30.

Subsequently, the main CPU 71 updates the number of the symbols BONUS 167 stored in the RAM 73 by subtracting 1 therefrom (S137). In the present embodiment, the number of the symbols BONUS 167 stored in the RAM 73 is updated to 2 by subtracting 1 from 3.

Subsequently, the main CPU 71 determines whether the number of the symbols BONUS 167 updated in S137 is larger than 0 (S138). In the present embodiment, because the number of the symbols BONUS 167 updated in S135 is 2, the number is determined as larger than 0 and the process proceeds to S135.

Subsequently, after the shifting to S135, the main CPU 71 again executes the number of times of execution of free game random determination process of determining the number of times of execution of the free game to be awarded (S135). In this number of times of execution of free game random determination process, in case of FIG. 29 and FIG. 21, the number of times of execution of the free game is randomly determined for the symbol BONUS 167 at "5".

Thereafter, as described above, the main CPU 71 executes the number of times of execution of free game display process (S136). In the number of times of execution of free game display process, the number of times of execution of the free game awarded as a result of the random determination in S135 is displayed on the front surface of the bonus symbol 167 as shown in (30-2) in FIG. 30 ("3" is displayed in the present embodiment). Furthermore, on the awarded number of times of execution of the free game display window 170, the total sum of the numbers of times of execution of the free game awarded in the free game addition process is displayed. In the present embodiment, "6 (3+3)" is displayed on the display window 170 shown in (30-2) in FIG. 30.

Subsequently, the main CPU 71 updates the number of the symbols BONUS 167 stored in the RAM 73 by subtracting 1 therefrom (S137). In the present embodiment, the number of the symbols BONUS 167 stored in the RAM 73 is updated to 1 by subtracting 1 from 2.

Subsequently, the main CPU 71 again determines whether the number of the symbols BONUS 167 updated in S137 is larger than 0 (S138). In the present embodiment, because the number of the symbols BONUS 167 updated in S137 is 1, it is determined that the number is larger than 0 and the process proceeds to S135.

After the shifting to S135, the main CPU 71 again executes the number of times of execution of free game random determination process of determining the number of times of execution of the free game to be awarded (S135). In this number of times of execution of free game random determination process, in cases of FIG. 29 and FIG. 21, the number of times of execution of the free game is randomly determined for the symbol BONUS 167 at "8".

Then the main CPU 71 executes the number of times of execution of free game display process as described above (S136). In the number of times of execution of free game display process, the number of times of execution of the free game awarded as a result of the random determination in S135 is displayed on the front surface of the bonus symbol 167 as shown in (30-3) in FIG. 30 ("30" is displayed in the present embodiment). Furthermore, on the awarded number of times of execution of the free game display window 170, the total sum of the numbers of times of execution of the free game awarded in the free game addition process is displayed. In the present embodiment, "36 (3+3+30)" is displayed on the display window 170 shown in (30-3) in FIG. 30.

Subsequently, the main CPU 71 updates the number of the symbols BONUS 167 stored in the RAM 73 by subtracting 1 therefrom (S137). In the present embodiment, the number of the symbols BONUS 167 stored in the RAM 73 is updated to 0 as 1 is subtracted from 1.

Thereafter, the main CPU 71 again determines whether the number of the symbols BONUS 167 updated in S135 is larger than 0 (S138). In the present embodiment, because the number of the symbols BONUS 167 updated in S137 is 0, it is determined that the number of not larger than 0 (S138: NO).

Figure 31:
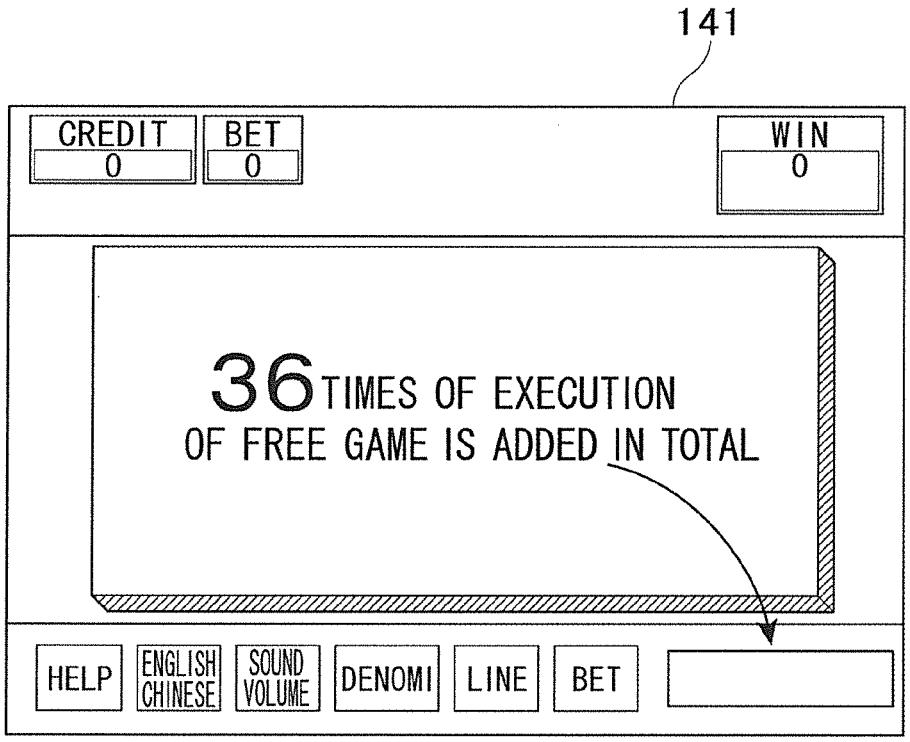
FIG. 31 shows an example of an image displayed on the lower image display panel in the free game addition process.

When the number of the symbols BONUS 167 updated in S137 is not larger than 0 (S138: NO), as shown in FIG. 31, the total sum of the numbers of times of execution of the free game awarded in the free game addition process is displayed on the front surface of the lower image display panel 141 (S139). In the present embodiment, the front surface of the lower image display panel 141 displays "36" which is the number of times of execution of the free game awarded in the free game addition process. Then the value "36" indicating the total sum of the number of times of execution of the free game awarded in the free game addition process is added to the remaining number of times of execution of the free game, and displayed on the remaining number of times of execution of the free game display window 185 (S140). The process is terminated after S140.

(Roulette Running Process)

Figure 17:
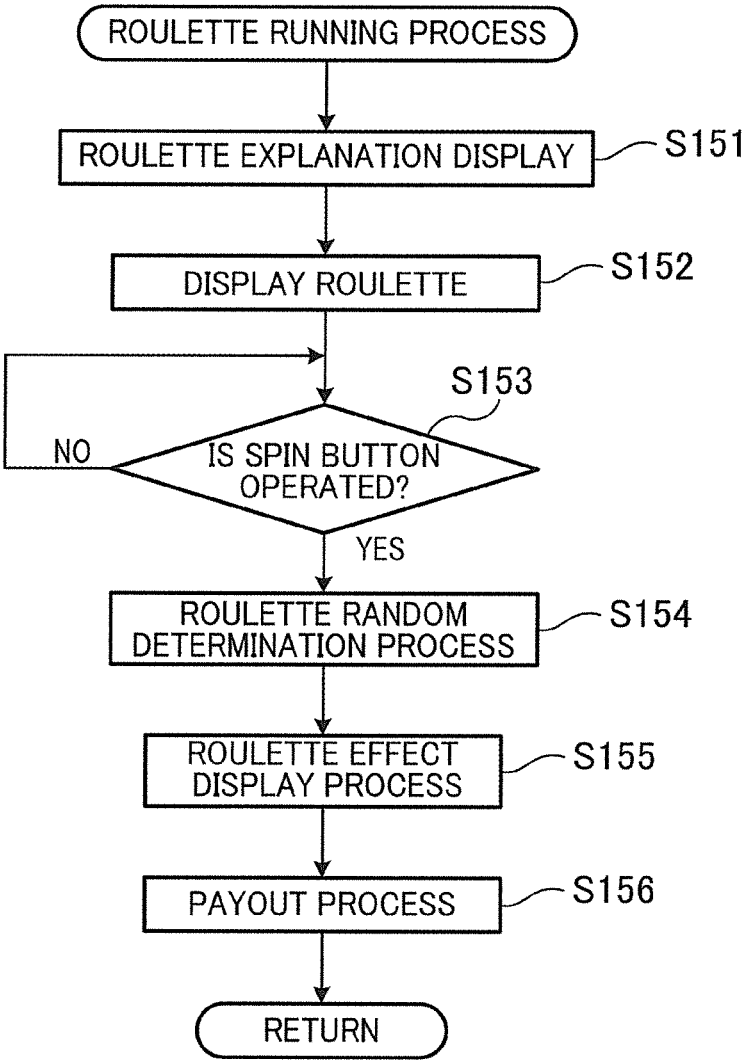
FIG. 17 is a flowchart of a roulette running process of the slot machine of First Embodiment.

Now, referring to FIG. 17, a roulette running process will be described. The roulette running process is, as shown in FIG. 14, executed when the roulette selection button 182 is selected in the bonus game process (see the step S84). While in the present embodiment the roulette game is executed as one-time game, the roulette game may be a different type of game on condition that benefit is awarded as a result of random determination once.

To begin with, the main CPU 71 displays, on the lower image display panel 141, a screen explaining the content of the roulette game (S151: roulette explanation display).

Subsequently, as shown in (32-1) in FIG. 32, on the lower image display panel 141, 10 targets 201A to 201J are displayed in a wheel-shaped manner (S152: roulette display). On each of these targets 201A to 201J, as described above, a payout credit is displayed. In the present embodiment, "10 credits" is displayed on the target 201A, "80 credits" is displayed on the target 201B, "20 credits" is displayed on the target 201C, "90 credits" is displayed on the target 201D, "30 credits" is displayed on the target 201E, "70 credits" is displayed on the target 201F, "40 credits" is displayed on the target 201G, "60 credits" is displayed on the target 201H, "100 credits" is displayed on the target 201I, and "50 credits" is displayed on the target 201J. In S152, a message prompting the player to press the spin button 46 is displayed on the lower image display panel 141.

Subsequently, the main CPU 71 determines whether the spin button 46 is pressed (S153). When the spin button 46 is not pressed (S153: NO), the process becomes on standby.

In the meanwhile, when the spin button 46 is pressed (S153: YES), the main CPU 71 executes a roulette random determination process (S154). In this process, with reference to a roulette payout table 193 (see FIG. 11), one of targets 201A to 201J is randomly selected based on a random number.

Subsequently, the main CPU 71 executes a roulette effect display process (step S155). In this process, as shown in (32-2) in FIG. 32, an effect is executed in such a way that, a light spot rotates on the targets 201A to 201J clockwise, and the light spot gradually slows down and stops at one of the targets 201A to 201J selected in the roulette random determination process in S154.

Subsequently, the main CPU 71 executes a payout process (step S156). In this process, a payout credit corresponding to one of the targets 201A to 201J selected in the roulette random determination process in S154 is multiplied by the total sum of the numbers of times of execution of the free game awarded in the bonus game process (see S79) and the bet amount (1-BET button 34, 2-BET button 35, 3-BET button 37, 4-BET button 38, 5-BET button 39, max bet button 45) received in the step S44, and the resultant payout is awarded to the player. The payout is stored in the payout amount storage area in the RAM 73. For example, when the target selected in the roulette random determination process in S154 is the target 201J, the total sum of the numbers of times of execution of the free game awarded in the bonus game process is 120 games, and the bet amount received in the step S44 is 3, the result of multiplying the payout "50 credits" corresponding to the target 201J by "120 games" and "3 bets" is 1800, and therefore 1800 credits are awarded to the player as the payout.

Furthermore, in S156, as shown in (32-3) in FIG. 32, the payout credit calculated in S156 is displayed on the lower image display panel 141. After S156, the roulette running process is terminated.

In S156 above, the expectation value of a payout awarded when the roulette game is selected may be set to a value calculated by multiplying an expectation value of a benefit awarded in response to the execution of the free game once by the awarded number of times of execution of the free game.

(Gamble Game)

Figure 33:
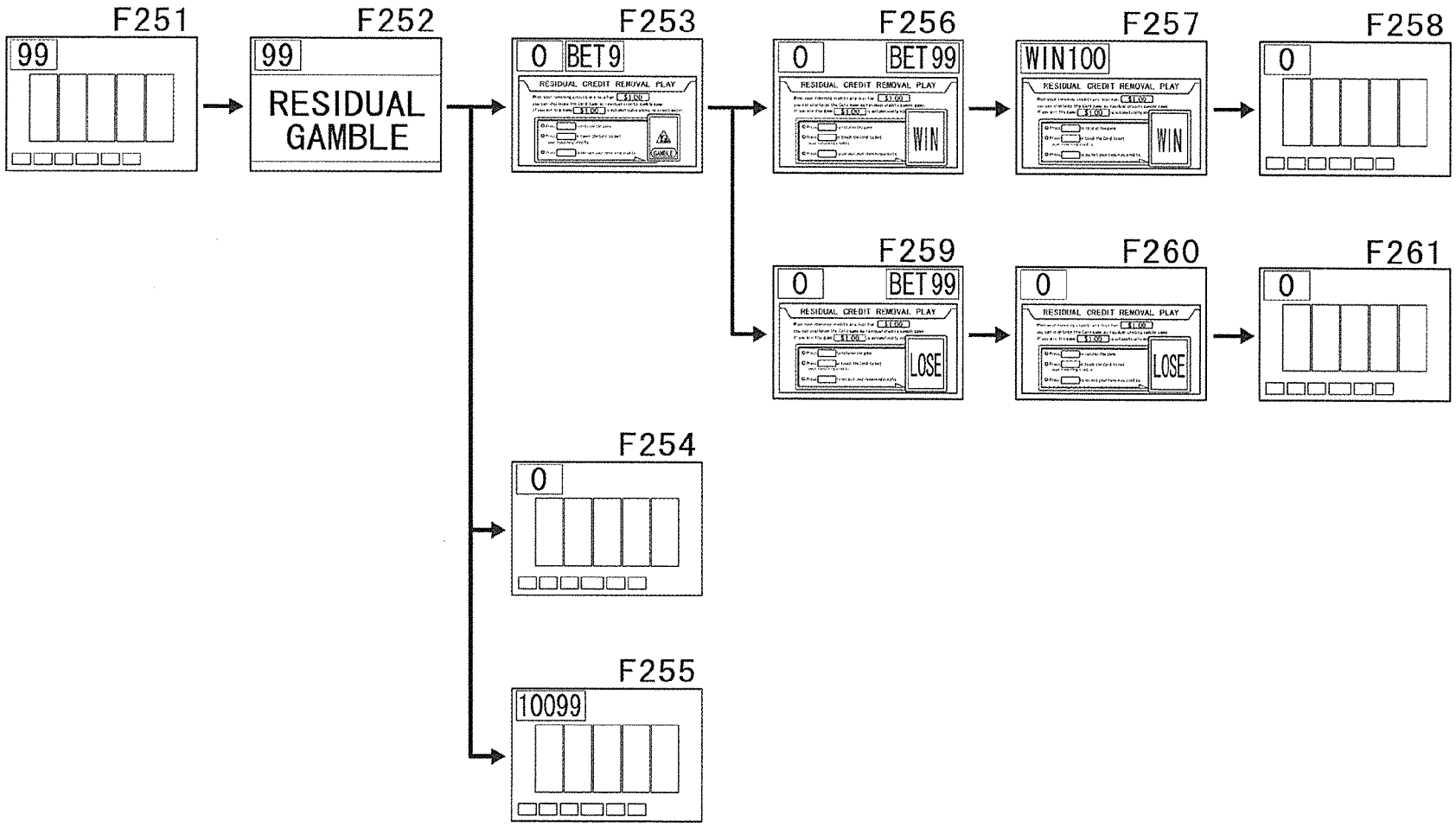
FIG. 33 is a flowchart of a gamble game.

As shown in FIG. 33, when the money is lower than the processable value such as one dollar, a "RESIDUAL GAMBLE" screen is displayed if a gamble start condition such as the pressing of a collect button is satisfied (F253). When the gamble button 44 is pressed, Gamble starts. On the other hand, when the collect button is pressed, Call Attendant is displayed (F254). When the spin button 46 is pressed, the screen of the normal game comes back (F255).

When "WIN" is achieved in Gamble (F256), a predetermined amount of money such as one cent is awarded and a token is paid out through the hopper. In addition to the above, the addition to the credit meter is executed (F257). Thereafter, after a predetermined time such as two seconds elapses, the screen of the normal game comes back (F258). On the other hand, when "LOSE" appears in Gamble (F259), a LOSE screen is displayed (F260). Thereafter, after a predetermined time such as two seconds elapses, the screen of the normal game comes back (F261).

The roles of the buttons in the progress of the gamble game will be described. In the cashout button 32, GAMBLE ON corresponds to "TAKE WIN" and GAMBLE OFF corresponds to "TAKE WIN". In the gamble button 44, GAMBLE ON corresponds to "Gamble Start" and GAMBLE OFF corresponds to "–". In the maximum BET button 45, GAMBLE ON corresponds to "Invalidated" and GAMBLE OFF corresponds to "Gamble Start". In the spin button 46, GAMBLE ON corresponds to "To Normal Game" and GAMBLE OFF corresponds to "To Normal Game".

Figure 34:
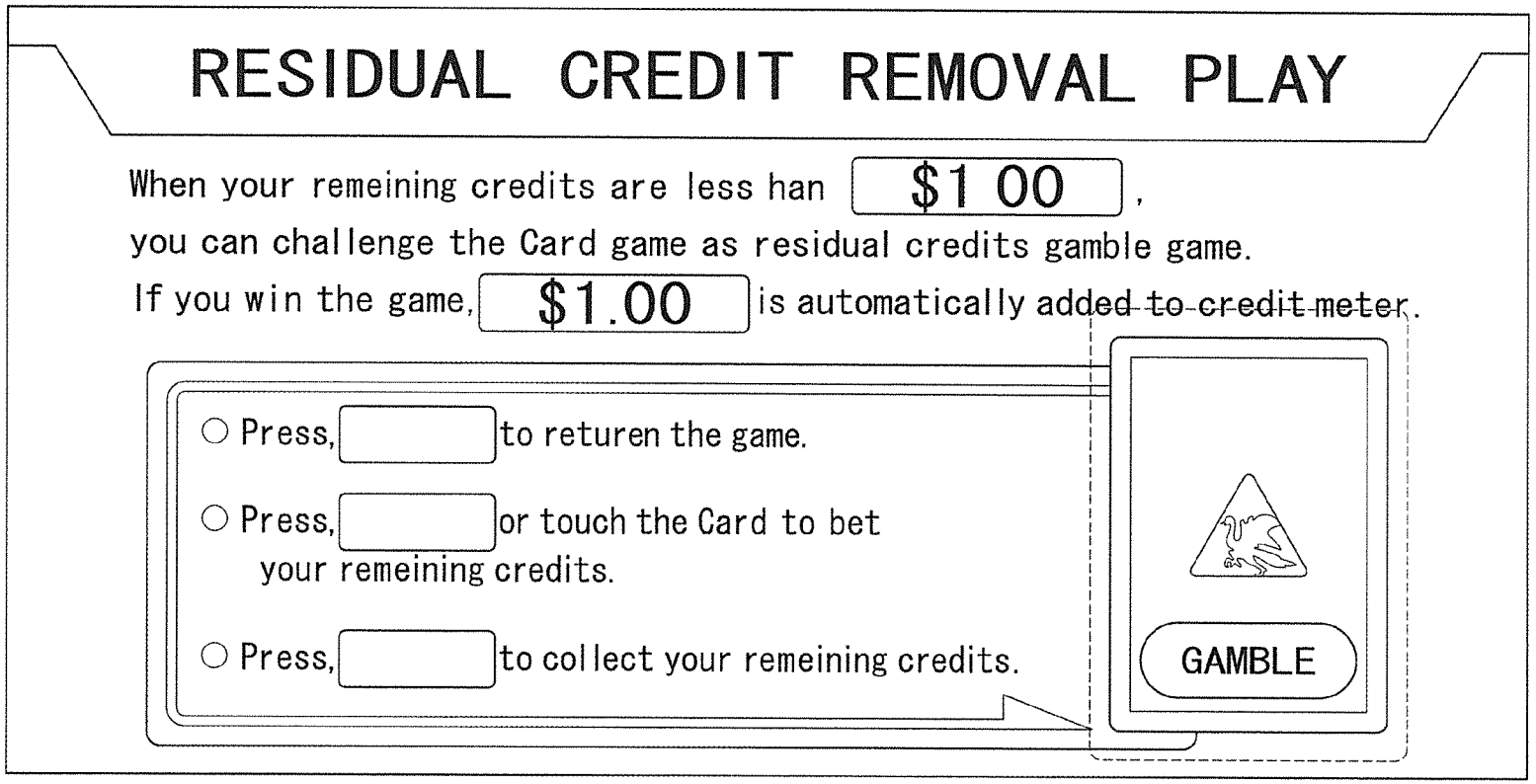
FIG. 34 illustrates a screen in a gamble game.

As shown in FIG. 34, the "RESIDUAL GAMBLE" screen has a card display area, a navigation area, and a meter area. In the card area is displayed a card image. The entirety of the card area has a touch sensor function. On the navigation area, various navigation texts are displayed.

The limit of the value winnable in Gamble is set in the AUDIT. The maximum number of times of Gamble is also set in the AUDIT. For example, the maximum number of times is set at five and the number of times of Gamble is set so as to be five or lower. Whether the touch panel can be used is switchable in some countries.

Figure 35:
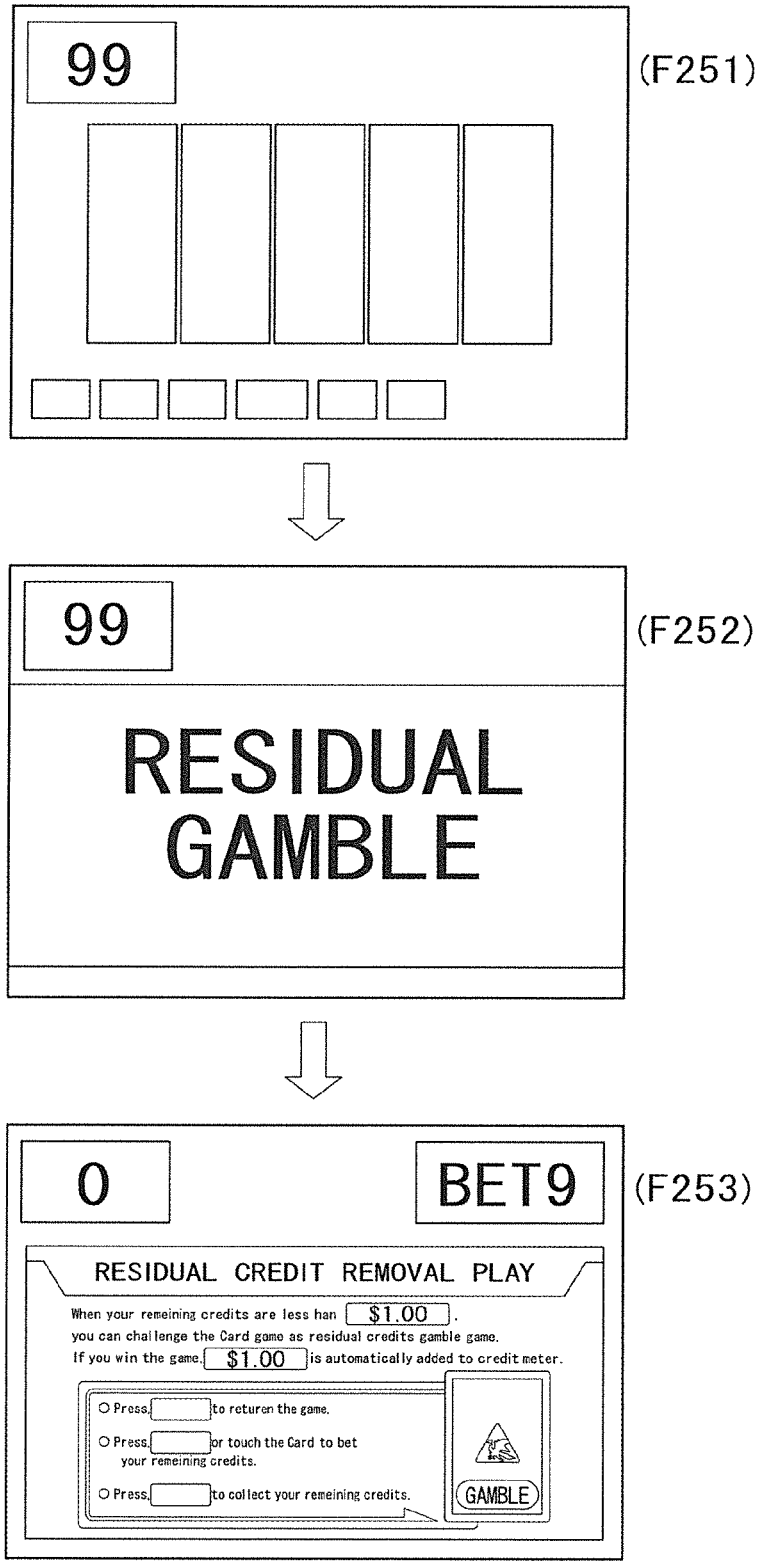
FIG. 35 illustrates operation steps of the gamble game.

As shown in FIG. 35, when the shifting to the gamble game occurs, the message "PLAY ON, GAMBLE or TAKE WIN RED" disappears. Immediately after the clearance of the RAM, the card history is empty until the gamble game is played. A message "SELECT RED OR BLACK OR TAKE WIN" is displayed. In the gamble screen, a heart-shaped red button and a spade-shaped black button are turned on and a TAKE WIN button at the center is turned on. The other buttons are turned off.

Figure 36:
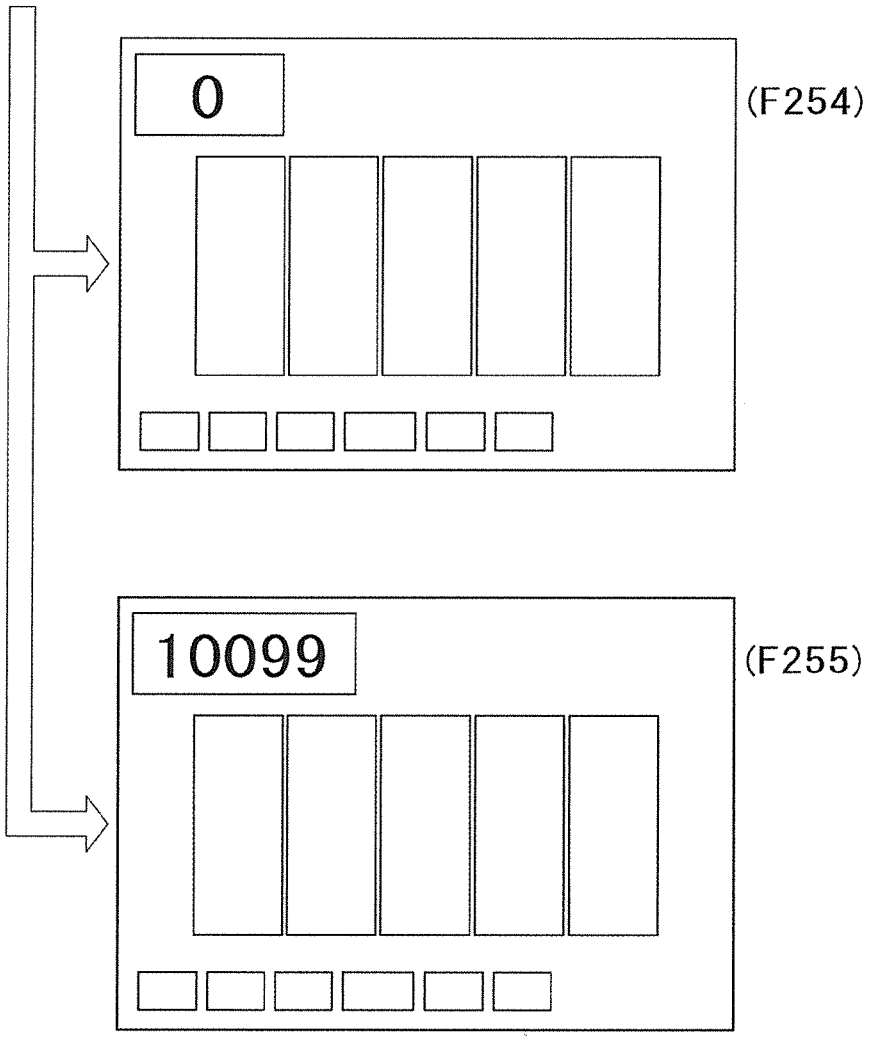
FIG. 36 illustrates operation steps of the gamble game.

Subsequently, as shown in FIG. 36, the amount bet on "GAMBLE AMOUNT" is displayed. Then one of the heart-shaped red button, the spade-shaped black button, and the TAKE WIN button at the center on the gamble screen is selected. When the TAKE WIN button is selected, the amount of WIN is added to the credits at once and the idle state comes back.

Figure 37:
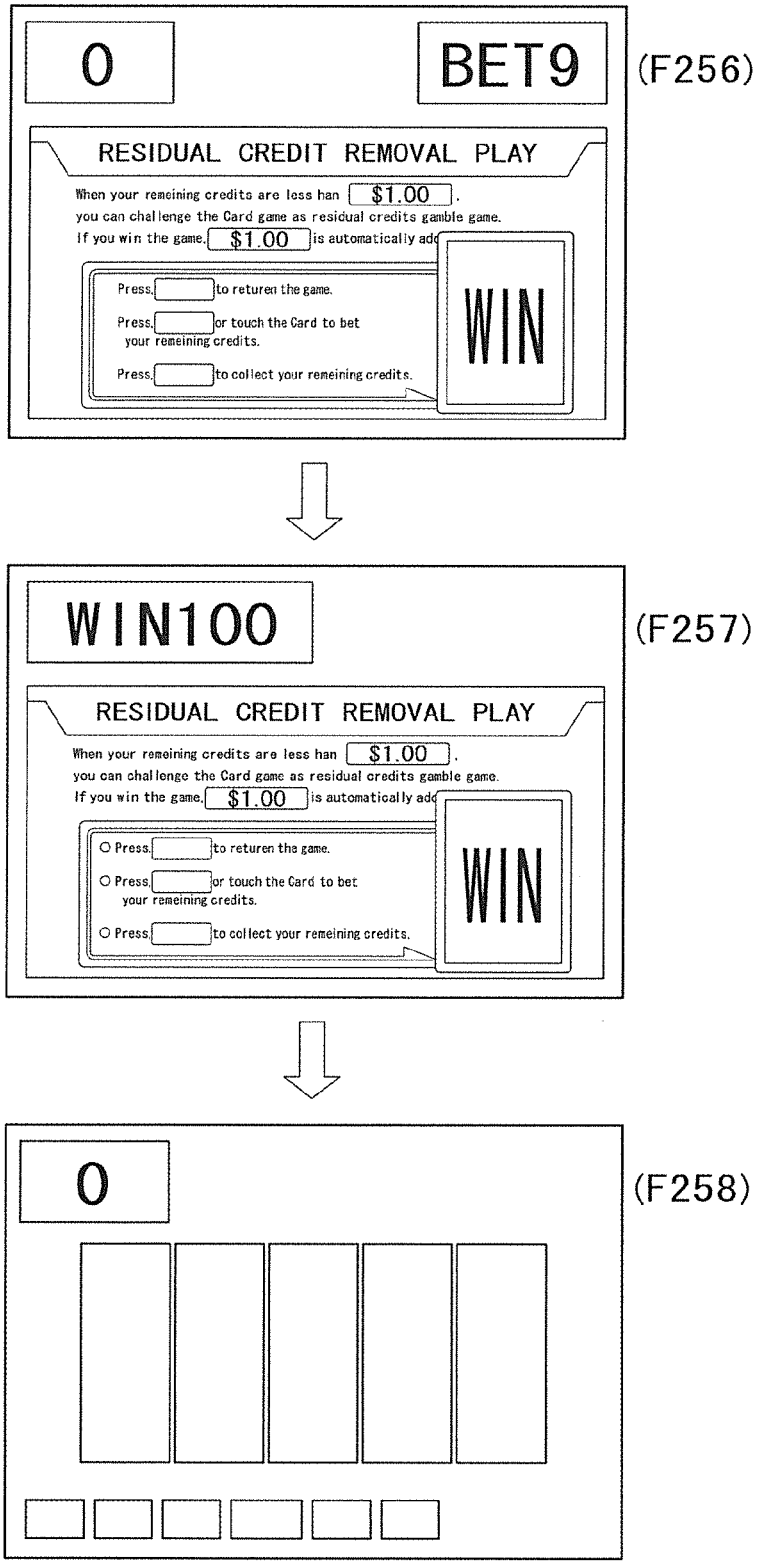
FIG. 37 illustrates operation steps of the gamble game.

In case of Miss in Gamble, as shown in FIG. 37, non-selected options are darkened. At the left edge of the gamble history field, the card history is displayed at once. The preceding card history moves right. The trace of the movement is not illustrated in animation, and hence the history is rewritten at once. The central card result is displayed at once. At this stage, there are no changes in the win meter and the gamble meter. Sound indicating hard luck is output and the shifting to the normal game occurs after several seconds.

Figure 38:
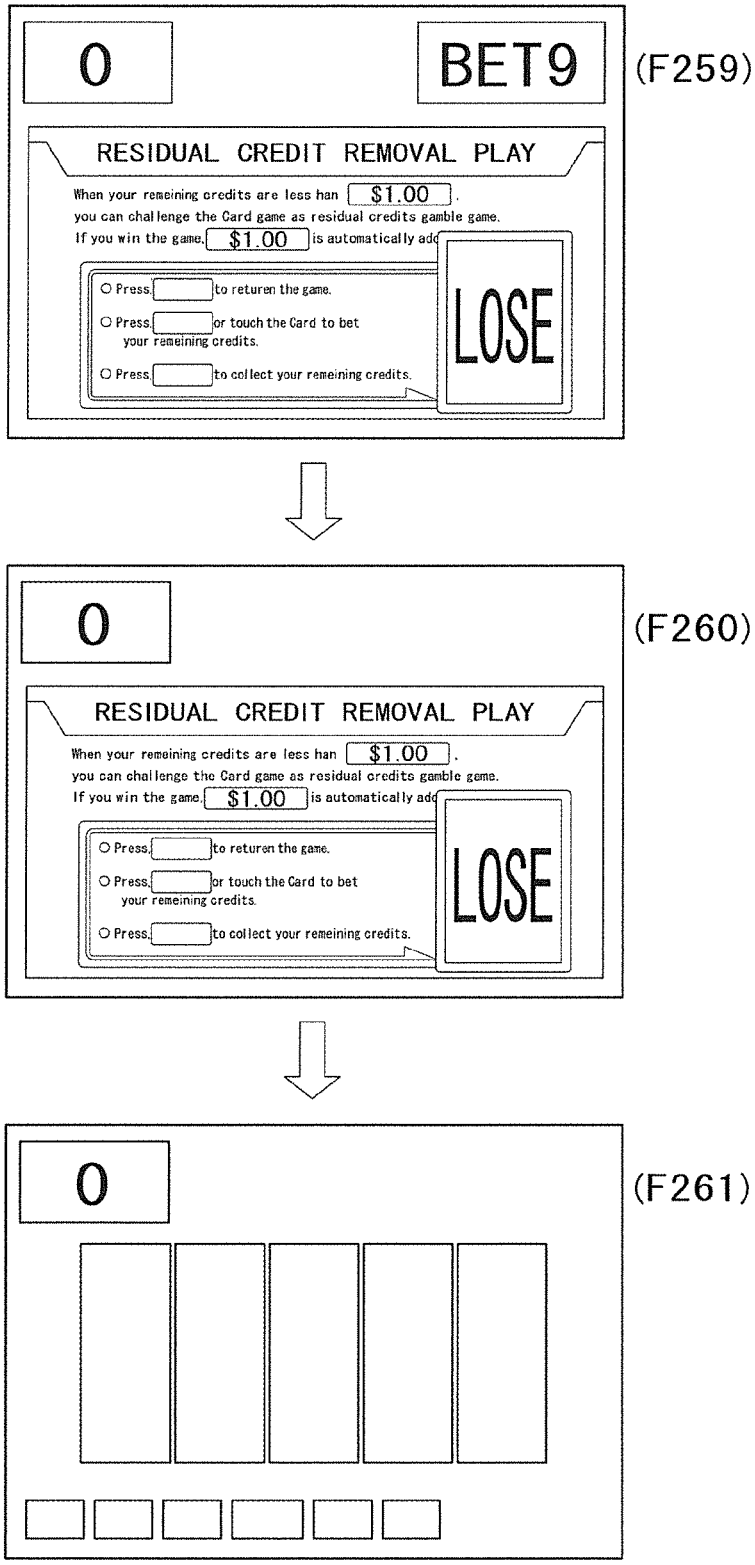
FIG. 38 illustrates operation steps of the gamble game.

In case of Success in Gamble, as shown in FIG. 38, non-selected options are darkened. At the left edge of the gamble history field, the card history is displayed at once. The preceding card history moves right. The trace of the movement is not illustrated in animation, and hence the history is rewritten at once. On the central card, a normal card and a card with a WIN text are alternately displayed at intervals of one frame, and success sound is output for a predetermined time. To the win meter, the value increase as a result of Gamble is added at once. When the player plays the gamble game until reaching the maximum number to times, the value won is added to the credits at once and the idle state comes back. As shown in FIG. 38, when the player has not played the gamble game until reaching the maximum number to times, a card is turned inside out and the gamble game is continued.

(Spin Button Prereading Function)

In addition to the above, the slot machine 10 may have a spin button prereading function with which, in a normal game, an input from the spin button 46 instructing to start the next game in the same conditions (the bet amount and the number of paylines) becomes receivable immediately after the end of the scroll of the symbol columns of the video reels 151 to 155. This function is performed to smoothly start the next game.

Figure 39:
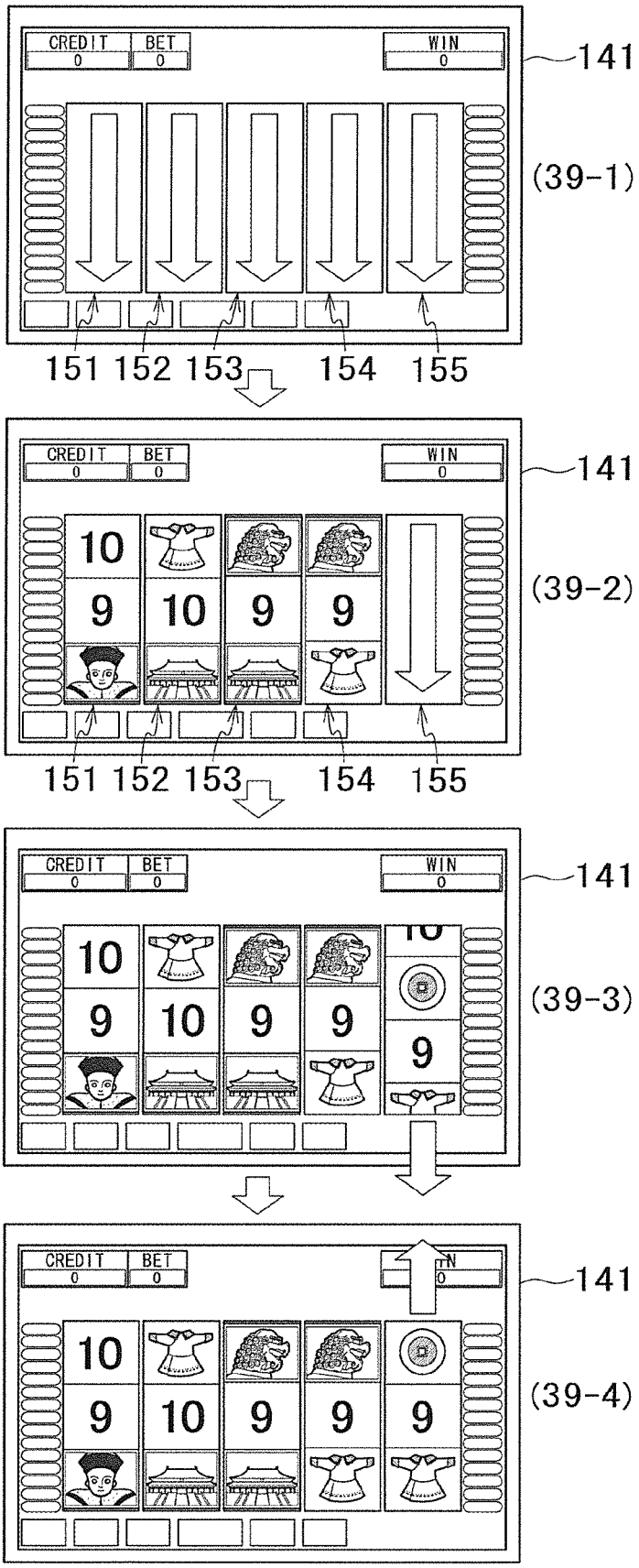
FIG. 39 is an explanatory diagram of a spin button prereading function.

More specifically, as shown in (39-1) in FIG. 39, in the symbol display control process of the main control process, the scroll of the symbol column of each of the video reels 151 to 155 starts. After a while, as shown in (39-2) in FIG. 39, the video reels 151 to 154 stop one by one, and only the fifth video reel 155 is still rotating. Thereafter, as shown in (39-3) in FIG. 39, an effect is performed such that the rotation of the fifth video reel 155 slows down and the symbol to be stopped sinks. Then, as shown in (39-4) in FIG. 39, an effect is performed such that the symbol to be stopped rises to the surface and stops (a bounding effect).

In the series of effects in the symbol display control process, a period during with the rotation of the fifth video reel 155 slows down, the symbol to be stopped sinks at the maximum, and then the symbol rises to the surface and stops is set as a spin button prereading period. In this period, an input instructing to start the next game in the same conditions is receivable from the spin button 46. When an input from the spin button 46 is received during the spin button prereading period, the next game starts immediately after the fifth video reel 155 stops.

In the spin button prereading function, the next game immediately starts but other effects and processes are not skipped. Furthermore, the spin button prereading function is available only when there is no payout based on a combination of symbols displayed on a payline 300. Furthermore, the spin button prereading function is available only when the remaining credit amount is sufficient to start the next game. Furthermore, when the spin button prereading function is available, an LED in the spin button 46 may be turned on.

When the slot machine 10 has a function of skipping the effect of scrolling and stopping the video reels 151 to 155, for example, the skip function is available until the video reels 151 to 154 stop and the skip function becomes not available after the stop of the fourth video reel 154. As such, the skip function and the spin button prereading function may coexist. In such a case, when the skip function is executed, the spin button prereading function is set to invalid. With this arrangement, even if the spin button 46 is mistakenly pressed twice to execute only the skip function, the next game does not unexpectedly starts due to the execution of the spin button prereading function.

According to the arrangement above, in the normal game, when symbols are rearranged on the lower image display panel 141 and a benefit corresponding to the combination of the rearranged symbols is bonus game trigger, how many symbols BONUS 167 are included in the rearranged symbols is determined. The random determination is executed based on the bonus game number random determination table 192 for the number of times corresponding to the number of the symbols BONUS 167, and the number of times of execution of the free game is awarded to the player as a result of the random determination.

When it is determined that the number of the BONUS symbols 167 in the combination of the rearranged symbols is 15, the execution of the free game 50 times is further awarded.

On this account, when the bonus game trigger is established, the more the symbols BONUS 167 are included in the rearranged symbols, the more times the random determination of the number of times of execution of the free game is executed. Furthermore, when the number of the BONUS symbols 167 is 15, the right to execute the free game 50 times is awarded. This encourages the player to be interested in the number of rearranged symbols. Furthermore, because the random determination of the total number of times of execution of the free game is executed for the number of times corresponding to the number of the symbols BONUS 167, the player enjoys the random determination for that number of times.

Furthermore, according to the arrangement above, based on the number of the symbols BONUS 167 rearranged when the bonus game trigger is established, the winning probability of the number of times of execution of the free game obtained by the random determination based on the bonus game number random determination table 192 varies. For example, it is possible to set the winning probability in such a manner that, the more the number of the BONUS symbols 167 rearranged when the bonus game trigger is established is, the larger the number of the times of execution of the free game to be awarded as a result of random determination based on the free game number random determination table 192 is. The player is therefore advantageous as the number of the BONUS symbols 167 rearranged when the bonus game trigger is established is large.

In addition to the above, according to the arrangement above, in S75, random determination is executed based on the bonus game number random determination table 192, and a result of the random determination of each time is displayed on the front surface of the bonus symbol 167 as shown in (22-1) to (22-3) in FIG. 22.

This allows the player to be interested in the awarded number of times of execution of the free game each time the random determination is executed.

According to the arrangement above, the player is allowed to choose the execution of the free game for the awarded number of times or the execution of the roulette game with which a benefit is awarded as a result of the random determination once.

With this arrangement, when, for example, the awarded total number of times of execution of the free game is large and it takes time to execute the free game for that number of times, the player may select the roulette game with which a benefit is awarded as a result of the random determination once, in order to shorten the time to run the free game for the awarded number of times.

In addition to the above, according to the arrangement above, because the expectation value of the payout awarded when the roulette game is selected is arranged to be equal to a value calculated by multiplying the expectation value of the benefit awarded by executing the free game once by the awarded number of times of execution of the free game, the payout to be awarded is mathematically identical between the case where the free game is executed for the awarded number of times and the case where the roulette game is selected. With this, no matter whether the execution of the free game is selected or the execution of the roulette game is selected, the player enjoys the game with the same expectation of the payout.

According to the arrangement above, furthermore, the player is able to know an estimated termination time which indicates when the running of the free game for the awarded number of times ends. This allows the player to choose the execution of the free game for the awarded number of times or the execution of the roulette game, in consideration of the notified estimated termination time.

According to the arrangement above, when bonus game trigger with which the awarded number of times of execution of the free game may be 100 or more is achieved, the player is allowed to select either the execution of the free game for the awarded number of times or the execution of the roulette game with which a benefit is awarded as a result of random determination once.

According to this arrangement, when, for example, the awarded total number of times of execution of the free game is large and it takes time to execute the free game for that number of times, the player may select the roulette game with which a benefit is awarded as a result of the random determination once, in order to shorten the time to run the free game for the awarded number of times.

According to the arrangement above, furthermore, a box symbol 168 (random symbol) is displayed on the video reels 151 to 155, and a symbol displayed in the box symbol 168 is randomly determined before the start of the game.

With this, a combination of symbols which is likely to be achieved varies in each game. In other words, as a payout which is likely to be awarded is different each time the game is run, the game play is diversified and becomes more entertaining for the player.

The above embodiment thus described solely serves as a specific example of the present invention, and the present invention is not limited to such an example. Specific structures of various means and the like may be suitably designed or modified. Further, the effects of the present invention described in the above embodiment are not more than examples of most preferable effects achievable by the present invention. The effects of the present invention are not limited to those described in the embodiments described above.

For example, while the descriptions above deal with one slot machine 10, the present invention may be employed in a game system including a plurality of slot machines 10 and an external controller connected with the slot machines 10 via a communication line.

The external controller controls the plurality of slot machines 10. For example, the external controller is a hall server installed in a gaming facility having the slot machines 10. Each of the slot machines 10 has a unique identification number, and the external controller identifies which one of the slot machines 10 transmitted data, by referring to the identification number. Further, when transmitting data from the external controller to any of the slot machines 10, the identification number is used for designating the transmission destination.

It is to be noted that the gaming system may be constructed within a single gaming facility where various games can be performed, such as a casino, or may be constructed among a plurality of gaming facilities. Further, when the gaming system is constructed in a single gaming facility, the gaming system may be constructed in each floor or section of the gaming facility. The communication line may be a wired or wireless line, and can adopt a dedicated line, an exchange line or the like.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine running a normal game and a bonus game developing from the normal game, the gaming machine comprising:

an input device configured to add a physical game medium with a monetary value to the gaming machine;

a validator configured to validate the physical game medium that has been added to the gaming machine;

an operation device configured to receive a bet from a player;

a symbol display device configured to display a result of a game by rearranging symbols;

an award payout mechanism by which other physical game medium is paid out to the player or is established as a credit balance for the player according to the result of the game;

a storage device configured to store a free game number random determination table in which the number of times of execution of a free game is associated with a random number; and a controller configured to establishes the credit balance based, at least in part, on the validated physical game medium, the player's bet, and the result of the game, the controller being programmed to execute, as a result of the player's bet, the processes of;

(1A) as the normal game, randomly selecting the symbols which are to be rearranged on the symbol display device;

(1B) rearranging the symbols selected in the process (1A) on the display device and awarding a benefit in accordance with a combination of the rearranged symbols;

(1C) when the benefit awarded in the process (1B) is the right to run the bonus game, counting how many predetermined bonus symbol is included in the combination of the symbols with which the right to run the bonus game is awarded;

(1D) performing random determination based on the free game number random determination table for the number of times corresponding to the number of the predetermined bonus symbol counted in the process (1C), wherein a free game number is randomly determined by the random determination for each predetermined bonus symbol and a total number is determined as a total sum of the free game numbers determined for the number of times corresponding to the number of the predetermined bonus symbol;

(1E) when the number of the predetermined bonus symbol counted in the process (1C) is equal to or larger than a predetermined number, awarding the right to execute the free game for a predetermined number of times; and (1F) when the number of the predetermined bonus symbol counted in the process (1C) is equal to or larger than the predetermined number, as the number of times of execution of the free game, awarding a sum of the total number determined in the process (1D) and the predetermined number of times awarded in the process (1E).

2. The gaming machine according to claim 1, wherein, the free game number random determination table used in the process (1D) defines that a winning probability of the number of times of execution of the bonus game varies in accordance with the number of the bonus symbol counted in the (1C).

3. The gaming machine according to claim 1, wherein, in the process (1D), a result of the random determination based on the free game number random determination table is notified each time the random determination is performed.

4. The gaming machine according to claim 1, wherein, the controller is programmed to further execute the processes of:

(1G) as options, presenting the execution of the free game for the number of times awarded as a result of the random determination in the process (1F) and the execution of a one-time game with which the benefit is awarded as a result of random determination once; and (1H) executing the bonus game for the awarded number of times when the execution of the bonus game is chosen in the process (1G), or executing the one-time game when the execution of the one-time game is chosen in the process (1G).

5. The gaming machine according to claim 4, wherein, an expectation value of the benefit awarded in the one-time game is equal to a value calculated by multiplying the expectation value of the benefit awarded as a result of running the free game once by the awarded number of times of execution of the free game.

6. The gaming machine according to claim 4, wherein, in the process (1G), an estimated termination time which indicates when the execution of the free game for the awarded number of times ends is notified.

7. The gaming machine according to claim 4, wherein, when the number of times of execution of the free game awarded in the process (1F) is 100 or more, the process (1G) of, as options, presenting the execution of the free game for the number of times awarded as a result of the random determination in the process (1F) and the execution of a one-time game with which the benefit is awarded as a result of random determination once is executed.

8. The gaming machine according to claim 1, wherein, the symbol display device displays the result of the game by displaying the symbols on reels and rearranging these reels, a random symbol is arranged on at least one of the reels, and each time the rearrangement of the reels starts, a symbol displayed in the random symbol is randomly determined.

9. A method of controlling a gaming machine running a normal game and a bonus game developing from the normal game, the gaming machine including:

an input device configured to add a physical game medium with a monetary value to the gaming machine;

a validator configured to validate the physical game medium that has been added to the gaining machine;

an operation device configured to receive a bet from a player; a symbol display device configured to display a result of a game by rearranging symbols;

an award payout mechanism by which other physical game medium is paid out to the player or is established as a credit balance for the player according to the result of the game;

a storage device configured to store a free game number random determination table in which the number of times of execution of a free game is associated with a random number; and a controller configured to establishes the credit balance based, at least in part, on the physical game medium, the player's bet, and the result of the game, the method comprising the steps of: under control of the controller, as a result of the player's bet, (2A) as a normal game, randomly selecting the symbols which are to be rearranged on the symbol display device;

(2B) rearranging the symbols selected in the step (2A) on the display device and awarding a benefit in accordance with a combination of the rearranged symbols;

(2C) when the benefit awarded in the step (2B) is the right to run the bonus game, counting how many predetermined bonus symbol is included in the combination of the symbols with which the right to run the bonus game is awarded;

(2D) performing random determination based on the free game number random determination table for the number of times corresponding to the number of the predetermined bonus symbol counted in the step (2C), wherein a free game number is randomly determined by the random determination for each predetermined bonus symbol and a total number is determined as a total sum of the free game numbers determined for the number of times corresponding to the number of the predetermined bonus symbol;

(2E) awarding the right to execute the free game for a predetermined number of times, when in the step (2C) the number of the predetermined bonus symbol is equal to or larger than a predetermined number; and (2F) when in the step (2C) the number of the predetermined bonus symbol is equal to or larger than the predetermined number, as the number of times of execution of the free game, awarding a sum of the total number determined in the step (2D) and the number of times of execution awarded in the step (2E).

* * * * *